US010563275B2

(12) United States Patent
Preston et al.

(10) Patent No.: US 10,563,275 B2
(45) Date of Patent: Feb. 18, 2020

(54) METHOD AND APPARATUS FOR SUPERCOOLING OF METAL/ALLOY MELTS AND FOR THE FORMATION OF AMORPHOUS METALS THEREFROM

(71) Applicant: Glassy Metals, LLC, Fall River, MA (US)

(72) Inventors: John T. Preston, Hingham, MA (US); Eric Dahlgren, Boston, MA (US); Steve Lemoi, Johnston, RI (US)

(73) Assignee: GLASSY METAL, LLC, Fall River, MA (US)

( * ) Notice: Subject to any disclaimer, the term of this patent is extended or adjusted under 35 U.S.C. 154(b) by 462 days.

(21) Appl. No.: 14/883,996

(22) Filed: Oct. 15, 2015

(65) Prior Publication Data

US 2016/0108484 A1 Apr. 21, 2016

Related U.S. Application Data

(60) Provisional application No. 62/064,754, filed on Oct. 16, 2014.

(51) Int. Cl.

| | |
|---|---|
| ***C21D 1/04*** | (2006.01) |
| ***C21D 1/84*** | (2006.01) |
| ***C21D 10/00*** | (2006.01) |
| ***C22C 1/00*** | (2006.01) |
| ***C22C 45/00*** | (2006.01) |
| ***C22F 3/02*** | (2006.01) |

(52) U.S. Cl.

CPC ..... *C21D 1/04* (2013.01); *C21D 1/84* (2013.01); *C21D 10/00* (2013.01); *C22C 1/002* (2013.01); *C22C 45/00* (2013.01); *C22F 3/02* (2013.01)

(58) Field of Classification Search

CPC .. C21D 1/04; C21D 10/00; C21D 1/84; C22C 1/002; C22C 45/00; C22F 3/02

USPC ..... 148/538

See application file for complete search history.

(56) References Cited

U.S. PATENT DOCUMENTS

| | | | |
|---|---|---|---|
| 5,128,214 | A | 7/1992 | Takayanagi et al. |
| 5,429,725 | A | 7/1995 | Thorpe et al. |

(Continued)

FOREIGN PATENT DOCUMENTS

| | | |
|---|---|---|
| WO | 8704378 | 7/1987 |
| WO | 2012147559 A1 | 11/2012 |

OTHER PUBLICATIONS

Bassler et al., The solidification velocity of pure nickel, Materials Science and Engineering, Apr. 11, 2002, p. 80-92, A342, Elsevier.

(Continued)

*Primary Examiner* — Colleen P Dunn
*Assistant Examiner* — Nicholas A Wang
(74) *Attorney, Agent, or Firm* — Hayes Soloway PC

(57) ABSTRACT

A method and apparatus are described for creation of amorphous metals using electromagnetic supercooling of a metal/alloy without the utilization of rapid quenching or immaculate process environments. By exposing the cooling melt to electric currents, either induced by an alternating current (AC) magnetic field or supplied directly, crystallization is suppressed, and the melt can reach significant levels of supercooling. With sufficient current densities in the melt, the supercooling can extend all the way into the glass transition range for certain materials, at which point an amorphous metal/alloy is created.

30 Claims, 19 Drawing Sheets

(56) References Cited

U.S. PATENT DOCUMENTS

| | | | | |
|---|---|---|---|---|
| 6,284,068 | B1 * | 9/2001 | McQueen | C21D 1/04 148/112 |
| 6,712,124 | B1 * | 3/2004 | Yamane | B22D 11/115 164/468 |
| 8,529,712 | B2 | 9/2013 | Demetriou | |
| 8,613,816 | B2 | 12/2013 | Kaltenboeck | |
| 8,657,967 | B2 | 2/2014 | Romera et al. | |
| 2004/0016477 | A1 | 1/2004 | Kuribayashi | |
| 2006/0081310 | A1 * | 4/2006 | Yokoyama | C22C 45/10 148/403 |
| 2006/0137778 | A1 | 6/2006 | Munir et al. | |
| 2007/0107467 | A1 * | 5/2007 | Miwa | B22D 27/02 65/30.13 |
| 2012/0006085 | A1 * | 1/2012 | Johnson | B21D 26/14 72/54 |
| 2013/0025814 | A1 * | 1/2013 | Demetriou | C21D 1/40 164/250.1 |
| 2013/0306198 | A1 | 11/2013 | Prest et al. | |
| 2013/0319062 | A1 | 12/2013 | Johnson et al. | |
| 2014/0090797 | A1 | 4/2014 | Waniuk et al. | |

OTHER PUBLICATIONS

Bergmann, Amorphous Metals and Their Superconductivity, Physics Reports, 1976, p. 159-185, Section C of Physics Letters 27 No. 4, North-Holland Publishing Company.

Bokeloh et al., Nucleation barriers for the liquid-to-crystal transition in simple metals: Experiment vs. simulation, The European Physical Journal Special Topics, Feb. 28, 2014, p. 511-526, 223, EDP Sciences, Springer-Verlag.

Chen, A brief overview of bulk metallic glasses, NPG Asia Materials, Sep. 2011, p. 82-90, vol. 3, Tokyo Institute of Technology.

Conrad, Influence of an electric or magnetic field on the liquid-solid transformation in materials and on the microstructure of the solid, Materials Science and Engineering, 2000, p. 205-212, A287, Elsevier Science S.A.

Eckler et al., Microstructures of dilute Ni—C alloys obtained from undercooled droplets, Journal of Crystal Growth, 1997, p. 528-540, 173, Elsevier Science B.V.

Herlach et al., Grain refinement through fragmentation of dendrites in undercooled melts, Materials Science and Engineering, 2001, p. 20-25, A304-306, Elsevier Science B.V.

Liaw et al., Bulk Metallic Glasses: Overcoming the Challenges to Widespread Applications, www.tms.org/jom.html, vol. 62 No. 2, JOM.

Liu et al., Overall effects of initial melt undercooling, solute segregation and grain boundary energy on the grain size of as-solidified Ni-based alloys, Journal of Crystal Growth, 2004, p. 392-399, 264, Elsevier B.V.

Liu et al., Solidification of Undercooled Molten Ni-Based Alloys, Metallurgical and Materials Transactions B, Jun. 2001, p. 449-457, vol. 32B.

Perepezko et al., Melt undercooling and nucleation kinetics, Current Opinion in Solid State and Materials Science, 2015, http://dx.doi.org/10.1016/j.cossms.2015.07.001, Elsevier Ltd.

Qian et al., An analytical model for constitutional supercooling-driven grain formation and grain size prediction, Acta Materialia, Mar. 11, 2010, p. 3262-3270, 58, Elsevier Ltd.

Schroers, Bulk Metallic Glasses, Physics Today, 2013, p. 32-37, 66, AIP Publishing.

Telford, The case for bulk metallic glass, materialstoday, Mar. 2004, p. 36-43, Elsevier Ltd.

Tian et al., Approaching the ideal elastic limit of metallic glasses, Nature Communications, Jan. 3, 2012, p. 1-6, Macmillan Publishers Limited.

Trexler et al., Mechanical properties of bulk metallic glasses, Progress in Materials Science, Mar. 20, 2010, p. 759-839, 55, Elsevier Ltd.

Tsuchiyama, Crystallization kinetics in the system CaMgSi2O6—CaAl2Si2O8: the delay in nucleation of diopside and anorthite, American Mineralogist, 1983, p. 687-698, vol. 68, University of Tokyo.

Willnecker et al., Nucleation in Bulk Undercooled Nickel-base Alloys, Materials Science and Engineering, 1988, p. 85-88, 98, Elsevier Sequoia, Netherlands.

* cited by examiner

METHOD AND APPARATUS FOR SUPERCOOLING OF METAL/ALLOY MELTS AND FOR THE FORMATION OF AMORPHOUS METALS THEREFROM

RELATED APPLICATIONS

This Application claims rights under 35 U.S.C. § 119(e) from U.S. Provisional Patent Application Ser. No. 62/064,754, filed Oct. 16, 2014, the contents of which are incorporated herein by reference.

FIELD OF THE INVENTION

This invention relates to the creation of glassy or amorphous metals and, more particularly, to the maintenance of a crystallization-free supercooled melt through the injection of energy into the melt during the cooling process in sufficient amounts to prevent crystallization to and permit the formation of a stable supercooled melt used as a precursor to the creation of glassy or amorphous metals when cooled to ambient temperature.

BACKGROUND OF THE INVENTION

The ability to produce amorphous metals, also called metallic glasses, from the liquid phase in significant sizes has long been pursued. However, practical production limitations imposed by the need for a combination of rapid cooling, immaculate process environments, and alloy compositions have limited the applicability of known production processes.

Perhaps the most touted quality of metallic glasses is their combination of mechanical strength, elasticity, hardness, and toughness. Crystalline metals/alloys above a very small scale have lattice defects disrupting the long-range atomic ordering. These defects are generally the initiation sites of mechanical failure. Without crystals and such crystal defects, amorphous metals tend to outperform their crystalline counterparts in strength and elasticity. In addition to their mechanical strength, the lack of grain boundaries and lattice defects makes the amorphous alloys resistant to corrosion and wear, rendering them suitable as components in harsh chemical/mechanical environments. Moreover, since amorphous alloys can maintain flow at relatively low temperatures without crystallizing, they can be molded into complicated shapes using techniques similar to thermoplastic molding.

A metallic glass is expected to have an electrical conductivity two orders of magnitude lower than the metal/alloy in its crystalline structure. As a result, efforts are being made to achieve not just the mechanical strength of metallic glass but also improved electrical conductivity. Moreover, it has been observed that metallic glasses of ferromagnetic materials can exhibit soft magnetization (i.e., almost no hysteresis in the B-H diagram as the magnetic field is cycled above and below zero). This property translates into very low losses when employed as magnetic cores in transformers or other magnetic components.

Supercooling, also known as undercooling, is the process of lowering the temperature of a liquid below its melting point without it becoming crystallized. Thermodynamically, the preferred state for most materials is a crystalline solid if the temperature is below the melting point of the particular material. The crystallization process is always initiated by one or more nucleation events in the liquid. The nucleation process is categorized as either heterogeneous or homogeneous, where heterogeneous nucleation is aided or catalyzed by a foreign element (e.g., for instance entrained impurities or the container wall), and homogeneous nucleation is induced by the base metal itself. For either category, nucleation is a random process, and the driving force increases with undercooling. Once a nucleus of sufficient size has formed, crystal growth ensues. However, if a liquid can be sufficiently supercooled, the kinetics of crystallization become prohibitively slow, and the liquid becomes frozen in an amorphous solid state without a crystalline structure. The temperature range where this occurs is called the glass transition range, and it differs from one material to the next.

Generally, in order to reach glass transition for metallic liquids, the liquid needs to be cooled sufficiently fast from the melting point down to glass transition in order to avoid nucleation and crystal formation. The necessary cooling rate depends on the material, and most efforts in the prior art are concerned with finding good glass formers—that is, alloy compositions that have inherently slow crystallization kinetics and/or a glass transition that is close to the liquidus temperature of the system.

There are several empirical rules for creating a good glass former. Among these rules is the notion that good glass formers tend to include at least three different elements and that these should differ by at least 12% in atomic radius. The stoichiometry of such glass-forming compositions also tend to lie close to deep eutectics. Such compositions tend to have a lower mobility when undercooled and, therefore, require a more modest critical cooling rate. Cooling a melt at a rate that is higher than this critical rate will bypass crystallization, and the melt will solidify as glassy. Indeed, limited to techniques known in the prior art, many metallic glasses can only be made with a thickness on the order of millimeters. Additionally, in order to achieve significant supercooling, it is generally considered necessary to operate in immaculate process environments to remove foreign substances and external nucleating agents in the melt. If such nucleating agents are present, the melt tends to undergo heterogeneous nucleation.

SUMMARY OF THE INVENTION

It has been found that significant levels of supercooling of metals, pure metals as well as various alloys, can be achieved without the need for either dramatic cooling rates or immaculate process conditions. The result is that one can create glassy metals without quenching or stringent processing. Specifically, it has been found that when a melt is subjected to electric currents, either induced magnetically or directly applied, crystallization can be suppressed during cool-down, and significant levels of undercooling can be achieved without crystallization. As a result of the subject process, one can obtain amorphous metals without quenching when bringing the temperature of the supercooled melt down to ambient temperature.

This method can either alleviate altogether the need for quenching of a melt in order to reach an amorphous state for the making of bulk parts or can be used in conjunction with existing processing methods with a reduced need for rapid quenching.

Moreover, the subject system does not rely on immaculate process environments nor the use of specialized alloy compositions for achieving and maintaining a supercooled state. Additionally, by increasing the strength of the currents during cooling, deeper supercooling can be achieved.

It has also been found that maintaining a reducing environment of the metal melt improves the process. Such an environment can involve, for example, hydrogen in the atmosphere or additives such as carbon to the melt in small quantities. The choice of reducing agent for a specific metal depends on the thermodynamic equilibrium of the metal oxide and the particular reducing agent at the operating temperatures, up to 200° C. above the melting point.

As will be described, a method for supercooling a melt without rapid quenching involves heating the metal above its melting point and then cooling the molten metal while injecting electromagnetic energy or electric currents into the melt of sufficient magnitude to suppress crystallization during cool down. It is thought that the electromagnetic field strength and the resulting current density, or direct current injection, is a key parameter in suppressing nucleation and prevention of crystal growth during cool down below the melting point of the metal at which crystallization normally occurs.

In one embodiment, a metal such as nickel, cobalt, copper, or iron is placed in a crucible surrounded by a coil which is driven at a frequency and with a current designed to induce eddy currents in the metal of sufficient magnitude to melt the metal. In a preferred embodiment, a nickel niobium alloy and a nickel boron alloy were found to yield an amorphous phase at room temperature.

It is preferable that the metal be exposed to a reducing agent, such as, for example, hydrogen or carbon in sufficient quantities to remove oxides present in the metal. Thereafter, the current in the coil is reduced, resulting in a cooling of the melt. Energy from the coil at the reduced current keeps the atoms of the metal in the molten state just sufficiently so that the supercooled melt does not pass into the crystalline stage or exhibit recalescence at temperatures below the melting point.

In an alternative embodiment, the magnetic or inductive coupling with the metal and the power source are replaced with a conductive coupling. That is, a current is run directly through the metal. The power source drives a current of a magnitude designed to melt the metal. Once the metal is molten, the magnitude of the current is reduced to sufficient levels such that the atoms of the metal in the supercooled melt do not pass into the crystalline stage or exhibit recalescence.

Moreover, for certain metal systems, it has been found that the degree or level of supercooling can be increased if, during cool down, the magnitude of the supplied currents can be increased. The increased amount of ohmic heating that follows from increasing the magnitude of the supplied currents is counteracted by also increasing the rate of heat extraction from the system. This can be accomplished by placing a conductive heatsink in contact with the primary containment of the metallic melt. The ability to remove heat from the melt utilizing thermal conductivity requires an identical amount of heat be added to the melt when maintaining a supercooled steady state.

It is theorized that crystallization is inhibited due to the mismatch in electrical conductivity between the nucleated solid state and the background liquid. With the solid state typically having a higher electrical conductivity, the nucleated phases will locally experience a higher current density compared with the bulk liquid phase as predicted by standard electrodynamics. The higher current density will generate additional heat where crystal growth would occur. This additional heat limits growth rates and melts the nucleated seeds to prevent crystallization.

In contrast to a nucleus of a pure metallic phase, metal oxides can have a lower electrical conductivity than the bulk liquid. The presence of such oxides can have the opposite effect. That is, current densities at the oxides are locally lower than in the surrounding melt, which consequently reduces ohmic heating locally. This, in turn, may result in crystallization.

This problem can be overcome or mitigated by removing the oxides present in the melt with a reducing agent such as hydrogen or carbon, which will reduce the oxides to pure metals and a gaseous component, steam or $CO_2$/CO in these cases, where the latter will leave the system.

The above-described methods of supercooling metals require neither extreme cooling rates, nor the need for immaculate environments, nor the need for complex alloy structures. This removes many of the practical limitations in supercooling metals which are necessary in making metal glasses.

More specifically, the three problems solved by the subject invention are: (1) the ability to control the supercooling of metals without resorting to complex alloy compositions; (2) the ability to supercool metals in a "dirty" reactor (i.e. a reactor that offers numerous nucleation sites); and (3) the ability to significantly supercool metals without requiring rapid quenching.

Provided sufficient strength of the applied currents during cooling, this method can be used to generate amorphous metals without quenching. Even if an amorphous state cannot be reached for a given metal or alloy composition with this method alone, due to the steady-state level of supercooling available significantly below its melting temperature, the additional quench supplied by prior art methods can have a reduced quench rate because the starting point is significantly below the melting temperature. This enables greater thickness of the produced glassy material.

Another benefit of this process is that, if crystallization is allowed to occur, either at the normal solidification temperature or in a supercooled state, when the melt is subjected to electric currents, the crystal structure can be manipulated. As a result, crystal size and orientation can be tuned with the applied field during crystallization isotropy of a given material. Thus, this technique provides a new process to tune structure.

BRIEF DESCRIPTION OF THE DRAWINGS

These and other features of the subject invention will be understood in connection with the Detailed Description in conjunction the Drawings, of which.

DETAILED DESCRIPTION

The main scientific discovery disclosed herein reveals that, when exposing a melt to either an electromagnetic field or to direct current, the natural process of nucleation and crystal growth is suppressed, allowing the melt to be significantly supercooled (i.e., without crystallization over substantial periods of time), thus to provide a stable supercooled melt. Moreover, the stronger the applied field, the greater the extent or depth of supercooling temperature below the equilibrium melting temperature that can be achieved. It is noted in the literature that the viscosity of the melt increases with supercooling. If the melt is sufficiently supercooled, the viscosity reaches such a magnitude that crystallization is kinetically inhibited, and the melt will solidify in an amorphous or glassy structure. The temperature at which point crystallization is made impossible is called the glass transition temperature. The glass transition temperature is different for different materials. The invention disclosed herein can, therefore, be used to supercool a metal/alloy melt completely through the glass transition temperature, thus producing a glassy material without the use of any methods in the prior art. Alternatively, it can be used in conjunction with prior methods to substantially reduce the amount of heat that needs to be extracted through rapid quenching in order to produce a glassy material.

The method to supercool disclosed herein has been proven robust enough to work in environments replete with nucleation sites, where otherwise heterogeneous nucleation would result in crystallization. Moreover, the method has been proven for more than one metal system, thereby also proving the versatility of the method.

In general, the change in heat content with time of the treated metal sample can be denoted AU. Assuming that the applied electromagnetic (EM) field is the only source of heat in the metal, the heat source per unit time can be denoted S, where S is a function which increases with the strength of the applied field. For a given set-up, the heat losses from the metal sample comprise conductive losses, convective losses, and radiative losses, collectively denoted Q. Combined, the heat balance can be stated as:

$$\Delta U = -Q + S.$$

When the metal is at steady-state at some temperature T, there is no change in heat content of the metal (i.e., $\Delta U=0$), and the losses are balanced by the source (i.e., Q=S). Increasing the heat extracted per unit time, that is, increasing Q, requires a stronger field, that is, a greater S, to achieve a steady state at the same temperature T. Experimental evidence disclosed herein shows that the field strength determined by coil current in embodiments depicted in FIGS. 1, 4, 9, 10, and 11, and by supplied current in embodiments depicted in FIGS. 5 and 8, in addition to supplying heat to the metal sample suppresses crystallization.

Figure 1:
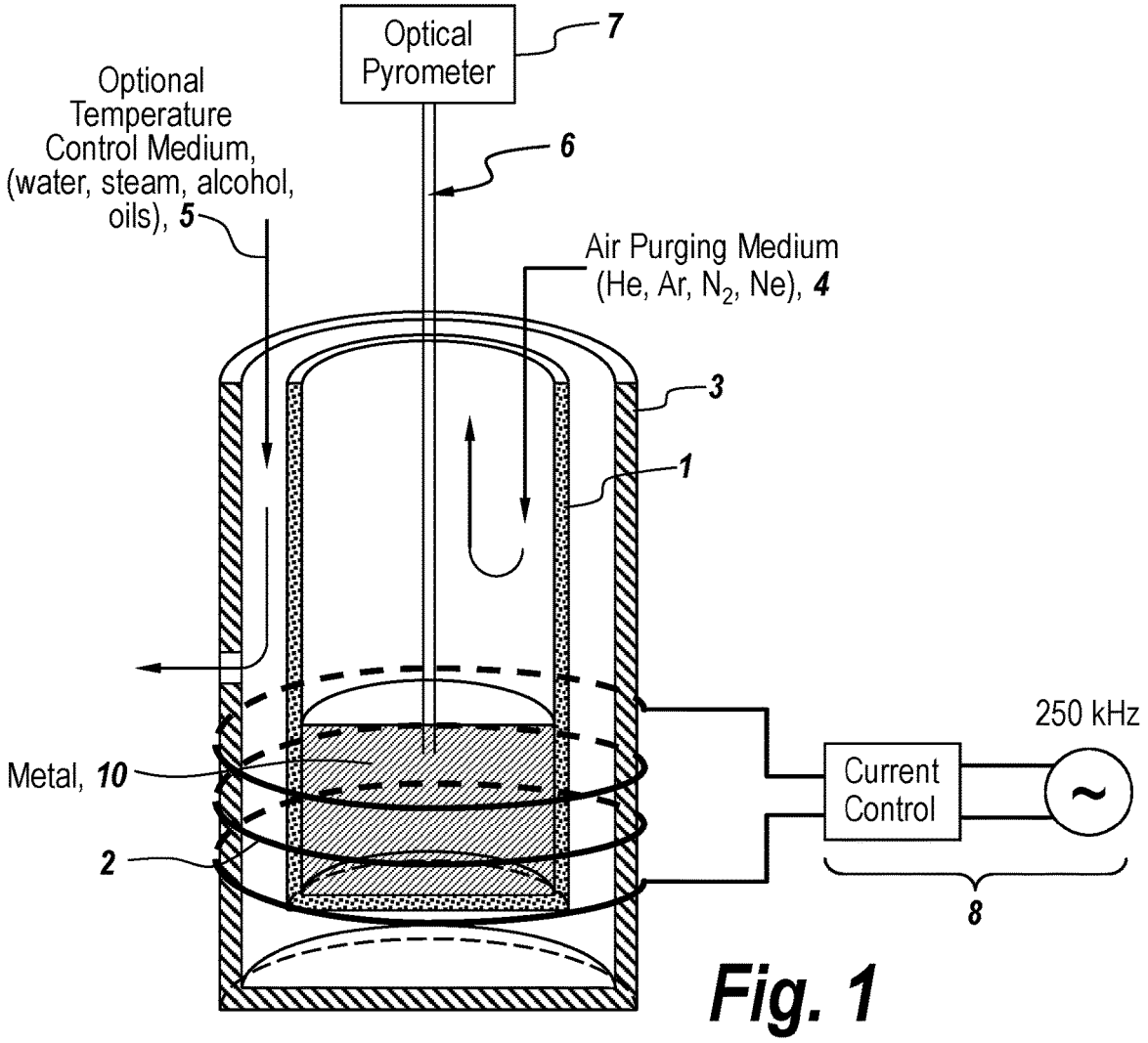
FIG. 1 is a diagrammatic illustration of a system to achieve supercooling without using rapid quenching.

Referring now to FIG. 1, in order to supercool a metal in one embodiment, a metal 10 is first contained in a primary containment vessel 1, such as a vitreous quartz crucible, and is heated inductively by passing a current through a work coil 2 that surrounds the metal 10 to be melted, although the metal 10 may be melted by other means without departing from the scope of the invention. In one embodiment, the current to the coil 2 is generated by a 250-300 kHz generator and is controlled by current control module 8 such that the current to the coil 2 is of a sufficient amplitude to heat the metal 10 to its molten state, at which time the current to the coil 2 is reduced to create conditions for a cool-down process.

Operating at lower frequencies would increase the skin depth (i.e., the penetration of the field into the metal 10) and is, therefore, foreseen to increase the crystallization suppression.

In order to purge the oxygen from the system, a bath of either helium, argon, nitrogen, neon, or other inert gas is introduced into the primary containment vessel 1. It has been documented in the literature that metal oxides present in the melt can impede the ability to supercool. Therefore, a reducing agent can be introduced into the primary containment vessel 1 in amounts sufficient to remove any pre-existing oxides from the metal 10, as well as keep new oxides from forming. Examples of such a reducing agent include, but are not limited to, graphite powder or a small addition of hydrogen in the purge gas.

In another embodiment, a secondary containment vessel 3, such as an external chamber, may surround the vessel 1 and may be used to contain an optional temperature control medium 5 such as water, steam, alcohol, or oils to control the temperature exterior to the vessel 1.

In one embodiment, a temperature sensor including an optical fiber 6 runs from an optical pyrometer 7 to the melt since it is desirable to measure the temperature of the melt as it transitions from a molten state to a glassy or solid state.

Figure 2:
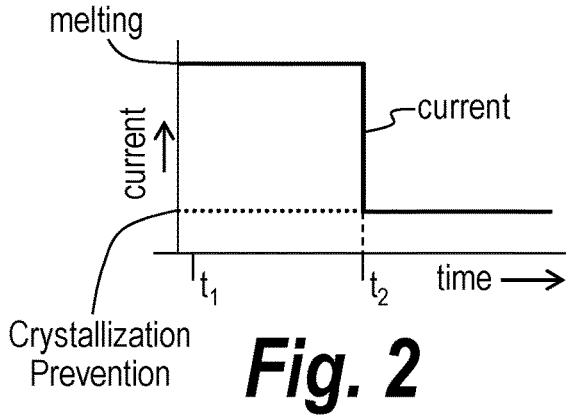
FIG. 2 is a current versus time graph of the current applied to the coil of FIG. 1.

As illustrated in FIG. 2, the current to the work coil 2 in FIG. 1 begins high enough to bring the metal 10 to a molten state and allows for the reducing agent to remove any oxides present. This current is then decreased to allow for cooling. In the case of nickel, the initial current to work coil 2 of FIG. 1, in one embodiment, is 175 A and is then reduced in steps. Note that the frequency of the RF energy in the coil 2 is between 250 and 300 kHz regardless of the current magnitude. In this step function decrease of current, the current does not go to zero, but rather steps down to a level where the metal 10 is supercooled without crystallizing.

During experimentation, it was found that reducing energy in the coil from 175 A to 107 A resulted in a supercooling to a thermally steady state. In one experiment, a thermal steady state was achieved at 290 K below the melting point of nickel, for a duration of 400 seconds.

It is found that this supercooling is significantly below the melting or fusing temperature of the metal, with crystallization that normally occurs when the temperature of the melt drops by as little as 2° C. The injection of energy into the melt as described herein is found to suppress crystallization.

Thus, it is a finding of this invention that supercooling of a metal can be made to occur without the use of rapid quenching. In one embodiment, this is accomplished by the introduction of electromagnetic energy into the melt during the cooling process, which takes the molten metal down to supercooled temperatures below the melting temperature of the metal. It is a specific finding of this invention that the supercooled temperature can be maintained without recalescence for significant periods of time in an environment where heterogeneous nucleation is expected to rapidly crystallize the metal.

Figure 3:
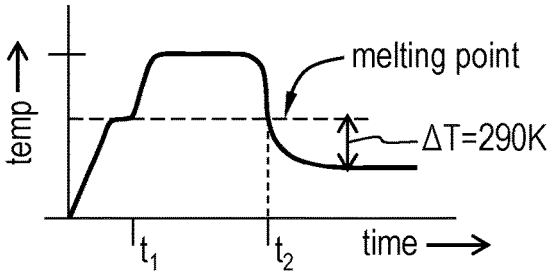
FIG. 3 is a temperature versus time graph showing an example of temperature conditions during supercooling in the apparatus of FIG. 1.

As illustrated in FIG. 3 and documented more thoroughly with experimental data presented in FIG. 20, the temperature corresponding to the current levels of FIG. 2 goes from the melting temperature of pure nickel to 280 K below the melting temperature without crystallization as evidenced by recalescence. Normally, the melt would start to crystallize when going below the melting temperature by as little as 2° C. It has been found that by maintaining the coil 2 as described above during a radiative cool down of the melt, a supercooled state for the nickel is maintained, in one embodiment, for over 2000 seconds. Thus, a supercooled thermal steady state for the cooling melt was achieved at supercooling levels of $\Delta T>280$ K for an extended period of time.

Figure 4:
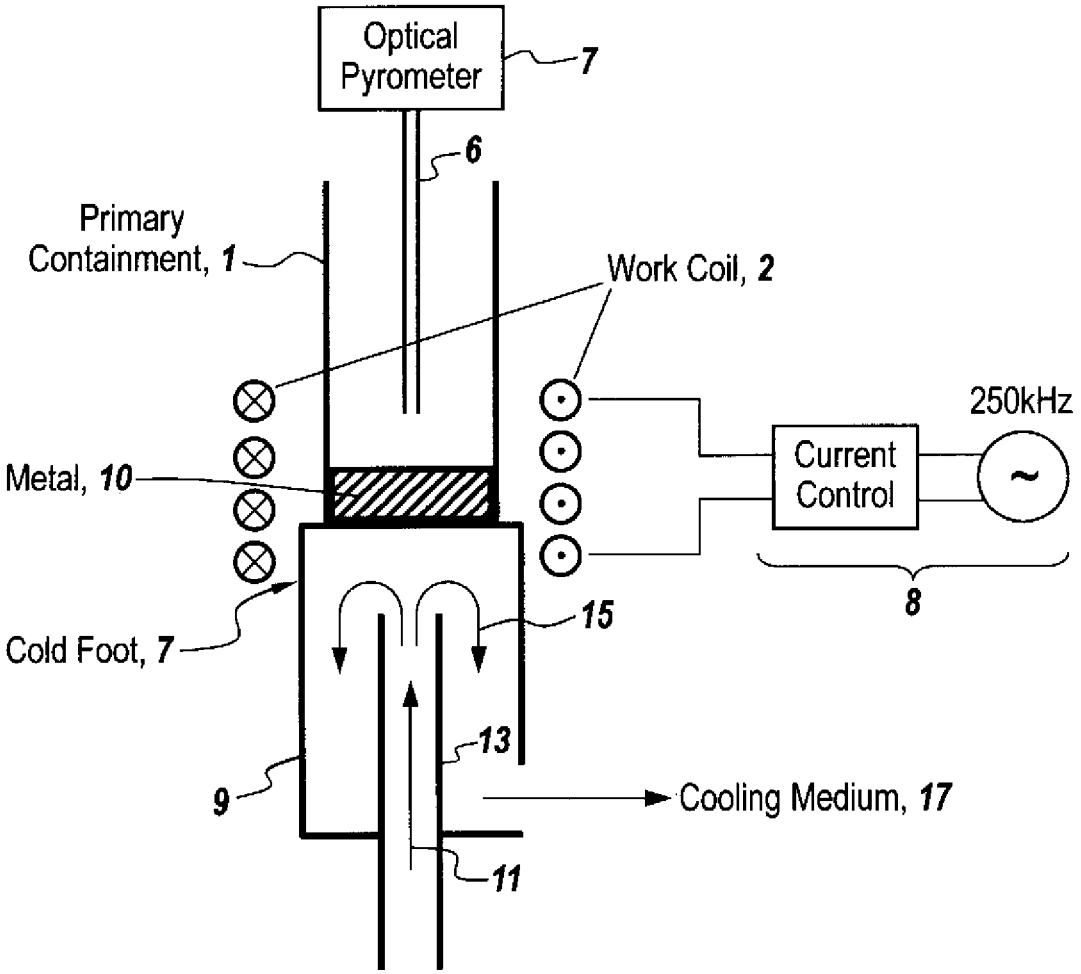
FIG. 4 is a diagrammatic illustration, similar to FIG. 1, but where a heat sink is placed in thermal contact with the primary containment to increase the heat extraction from the metal during the process, which requires a higher coil current to reach the same temperature as without the heatsink present, which in turn results in increased crystallization suppression.

As illustrated in FIG. 4, what is described is a system for further increasing the degree of supercooling utilizing the equipment and procedures associated with FIG. 1. This is done by providing an additional cooling modality and by increasing the energy injected into the melt by an amount equal to the energy removed by the cooling modality. By being able to add more energy into the melt as the melt cools down, crystallization is even further suppressed. This makes possible an increase in the depth of the supercooling $\Delta T$, the difference in temperature between the normal melting point of the metal 10 and the temperature associated with a supercooled steady state. This crystallization suppression effect is documented more thoroughly with experimental data presented in FIG. 21, in which apparatus similar to that shown in FIG. 4 is provided with a heatsink 34 in the form of an aluminum surface in thermal contact with the bottom of the primary containment vessel 1 utilized to hold the melt. This heat sink 34 or additional cooling modality is called a "cold foot" and is placed in thermal contact with the primary containment vessel 1 of metal 10. Current totaling 400 A is now required to bring the nickel into the molten state. It is found that a current of around 250 A now allows the system to settle at a thermal steady state at a supercooling temperature of more than 295 K below normal solidification temperature for an extended period of time. Note that the heatsink 34 includes a chamber 9, into which a coolant 11 is introduced through conduit 13, exits the conduit 13 as illustrated at 15, and is ported out of chamber 9 as illustrated at 17.

In one embodiment of the subject invention, pure nickel at approximately 1.7 g was used for metal 10. The experiments were performed in a quartz crucible in an argon-hydrogen mixture atmosphere at ambient pressures. Conventional theory implies that supercooling a sample of this size to levels $\Delta T$ of more than 300 K should not, as a practical matter, be feasible unless all heterogeneous nucleation sites are removed or rapid quenching is employed. Nonetheless, modest cooling rates of less than 20 K/s have been found to achieve the stated levels of supercooling, and there are no special actions taken to remove nucleating agents other than the reducing environment. Moreover, the melt was then maintained at steady state at this level of supercooling for extended periods of time.

The disclosed method of supercooling metals requires neither 1) extreme cooling rates, nor 2) the need for immaculate environments, nor 3) the need for complex alloy structures, nor 4) the need for ultra-small or ultra-thin samples, thereby removing many or most of the practical limitations to make metal glasses.

Significant levels or depths of supercooling of various metals such as pure nickel, pure cobalt, and pure copper, as well as nickel plus carbon or iron plus carbon, have been achieved. The actual method is very straightforward. Simply exposing the melt to injected energy at power levels below those corresponding to the melting temperature of the metal acts to suppress crystallization of the molten metal. Other energy sources may be utilized in place of the energized coil 2. It is clear that the strength of the applied field relative to heat removal rate is a key determinant of the levels of supercooling that can be attained. This can be seen in comparing FIGS. 17, 18A, and 18B. These Figures correspond to the setup in FIG. 4, where a heatsink 34 requires a stronger field and actually allows the liquid to reach lower temperatures without crystallizing.

Figure 5:
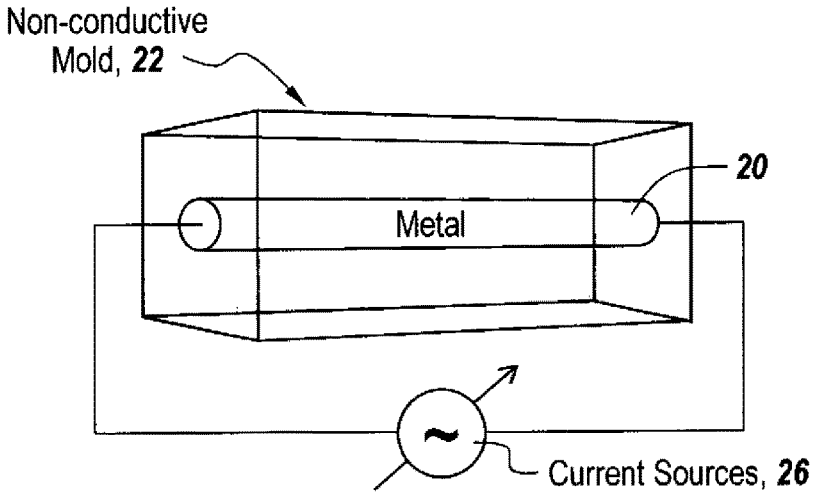
FIG. 5 is a diagrammatic illustration of an alternative embodiment in which the metal to be melted and supercooled is a metal rod carried in a nonconductive mold.
Figure 6:
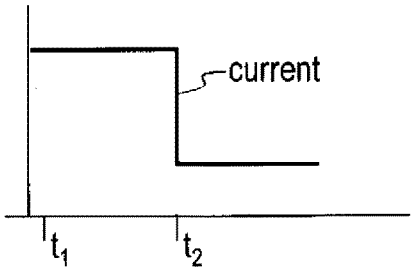
FIG. 6 is a current versus time graph of the power applied across the metal rod of FIG. 5.
Figure 7:
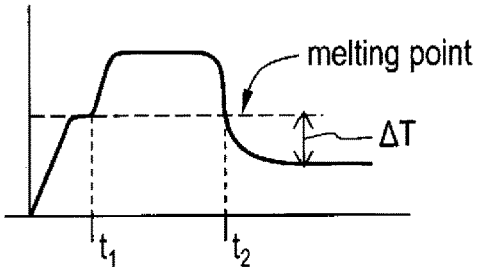
FIG. 7 is a temperature versus time graph of the temperature of the metal rod after melting, indicating passage to a supercooled state without crystallization.

Referring to FIG. 5, what is shown is a still further alternative embodiment. Rather than using inductive heating to melt the pure metal, a pure metal rod 20 is inserted into a nonconductive mold 22. The metal rod 20 within the nonconductive mold 22 is melted in a reducing environment through the utilization of alternating current (AC) or direct current (DC) from a current source 26 such that the metal rod 20 is melted within the nonconductive mold 22. The current applied to the metal rod 20 is shown in FIG. 6 to be a step function such that when the current is reduced the molten metal cools in the presence of injected energy from current source 26. The temperature profile is shown in FIG. 7, in which, after melting and the decrease of current to bring the metal to the fusion temperature, a supercooled state ensues due to the injection of the current. The melt is supercooled by controlling the current through the metal rod 20, similar to the way the current through the coil 2 was controlled relative to FIGS. 1 and 4.

Figure 8:
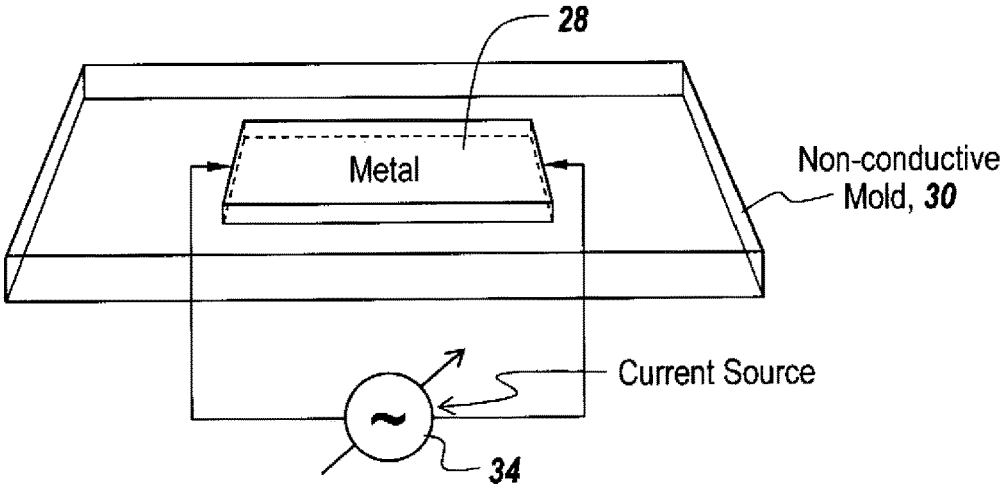
FIG. 8 is an alternative embodiment illustrating the utilization of a metal plate across which is applied current to melt the metal, with a nonconductive mold supplied with a cooling medium.

Referring to FIG. 8, rather than using a metal rod 20, a metal plate 28 is contained within a rectilinear nonconductive mold 32. The metal plate 28 is contacted at either end by current from a current generator 34 and operates in the same manner as that described in connection with FIGS. 5, 6, and 7.

Figure 17:
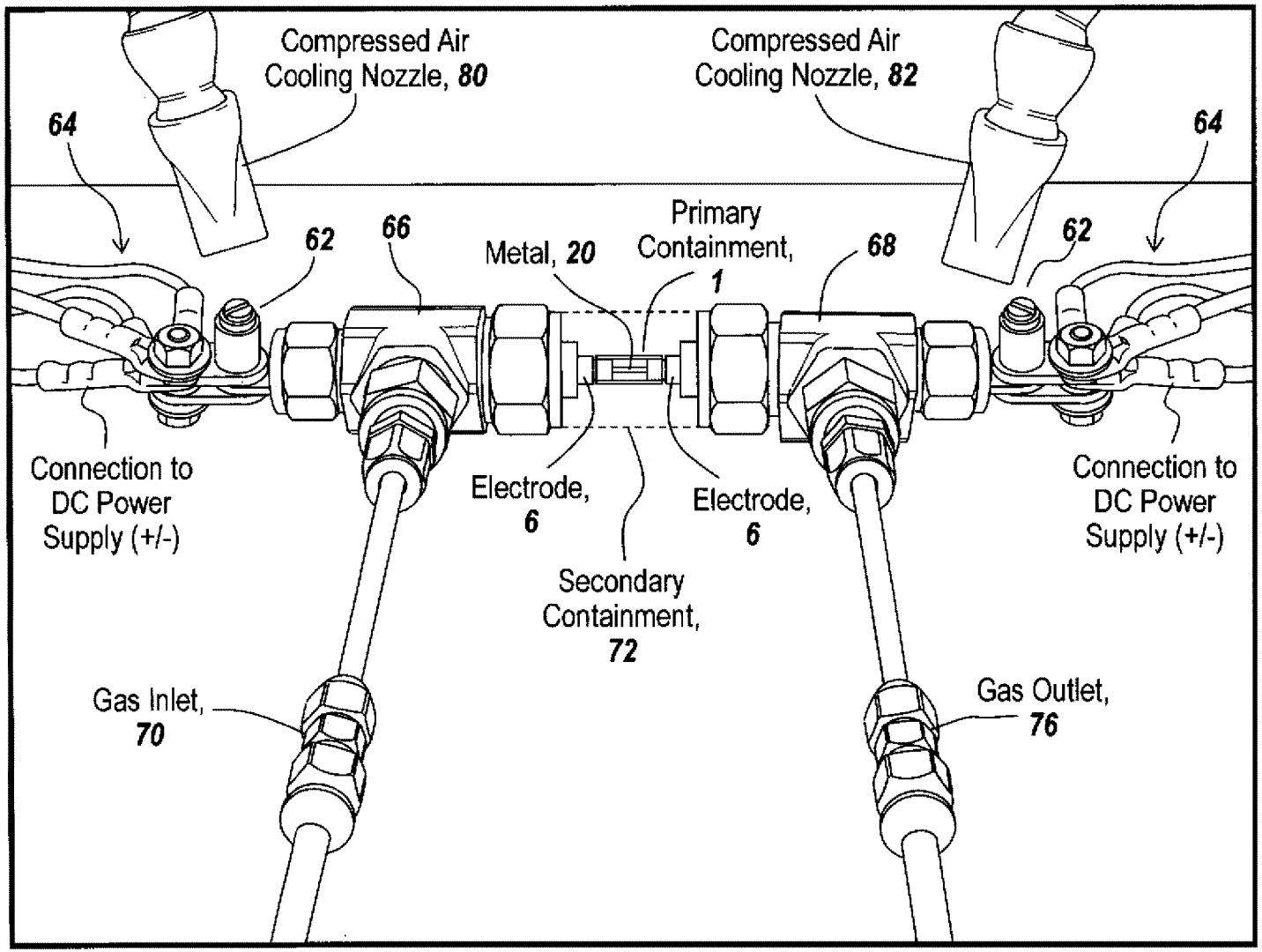
FIG. 17 is a diagrammatic illustration of experimental apparatus using a direct current to melt and supercool a metal.

Referring to FIG. 17, a diagram of the experimental apparatus that refers to the embodiment in FIG. 5, in which the metal rod 20 is placed in a primary containment vessel 1 made of vitreous quartz. The metal rod 20 is contacted by two graphite electrodes 6 supplying an electric current through the metal rod 20. The choice of electrode material depends on thermal stability at the operating temperature (i.e., between 50 and 200° C. above the melting point of the primary metal) and dissolution in the melt, as well as thermal and electrical conductivity. The primary containment vessel 1 is housed in a secondary containment vessel 3 sealed against one end of each of the electrodes 6. The electrodes 6 are connected to leads 64, which connect to a DC power supply. The secondary containment vessel 3 is purged with either an inert gas or an inert gas with added hydrogen through the inlet 70/outlet 76. The electrodes 6 not only conduct an electrical current, they also conduct heat away from the molten metal. This requires cooling at the leads, which is provided by blowing compressed air through nozzles 80, 82.

Figure 9:
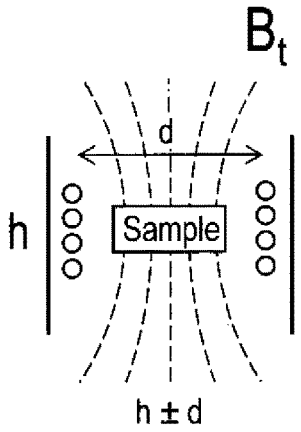
FIG. 9 is a diagrammatic illustration of the utilization of a single coil for the induction melting and subsequent treating of a metal, indicating the magnetic lines of flux and a height to depth ratio h/d=1.

As to the embodiment shown in FIG. 1, and referring now to FIG. 9, a so-called short coil 2 may be utilized, in which height of the coil 2 (h) is approximately equal to the diameter (d) of the coil 2.

Figure 10:
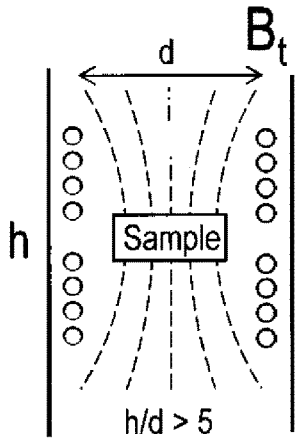
FIG. 10 is a diagrammatic illustration of the utilization of a split coil for the melting and processing of the sample of FIG. 9 illustrating the magnetic lines of force and a height to depth ratio of h/d greater than 5.

Alternatively, and referring to FIG. 10, in a long coil 2 embodiment, the ratio of h/d is greater than 5.

Figure 11:
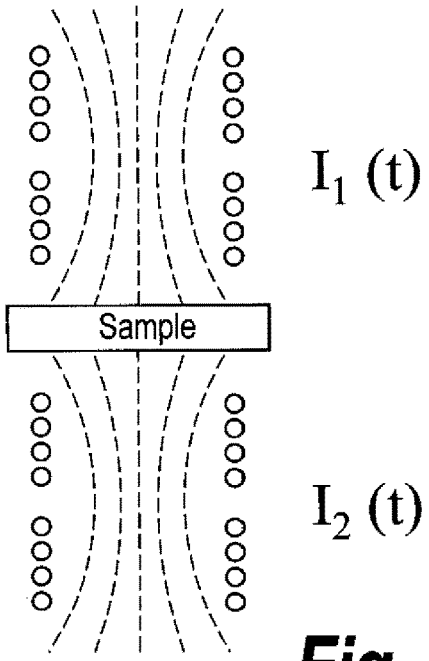
FIG. 11 is a diagrammatic illustration of the utilization of coils to either side of the sample to be melted, in which two different currents are applied to the coils with a phase relationship between the first and second coils to produce the indicated magnetic flux.

In a further embodiment, and referring to FIG. 11, two coils 2 are utilized, with a sample being placed between the two coils 2. The applied currents are applied as illustrated with a possible phase shift between the currents in the two sets of coils 2 from zero through $\pi/2$.

Experimental Setup

Referring to FIGS. 12-17, what is shown is a description of the experimental setup used in the subject invention.

Figure 12:
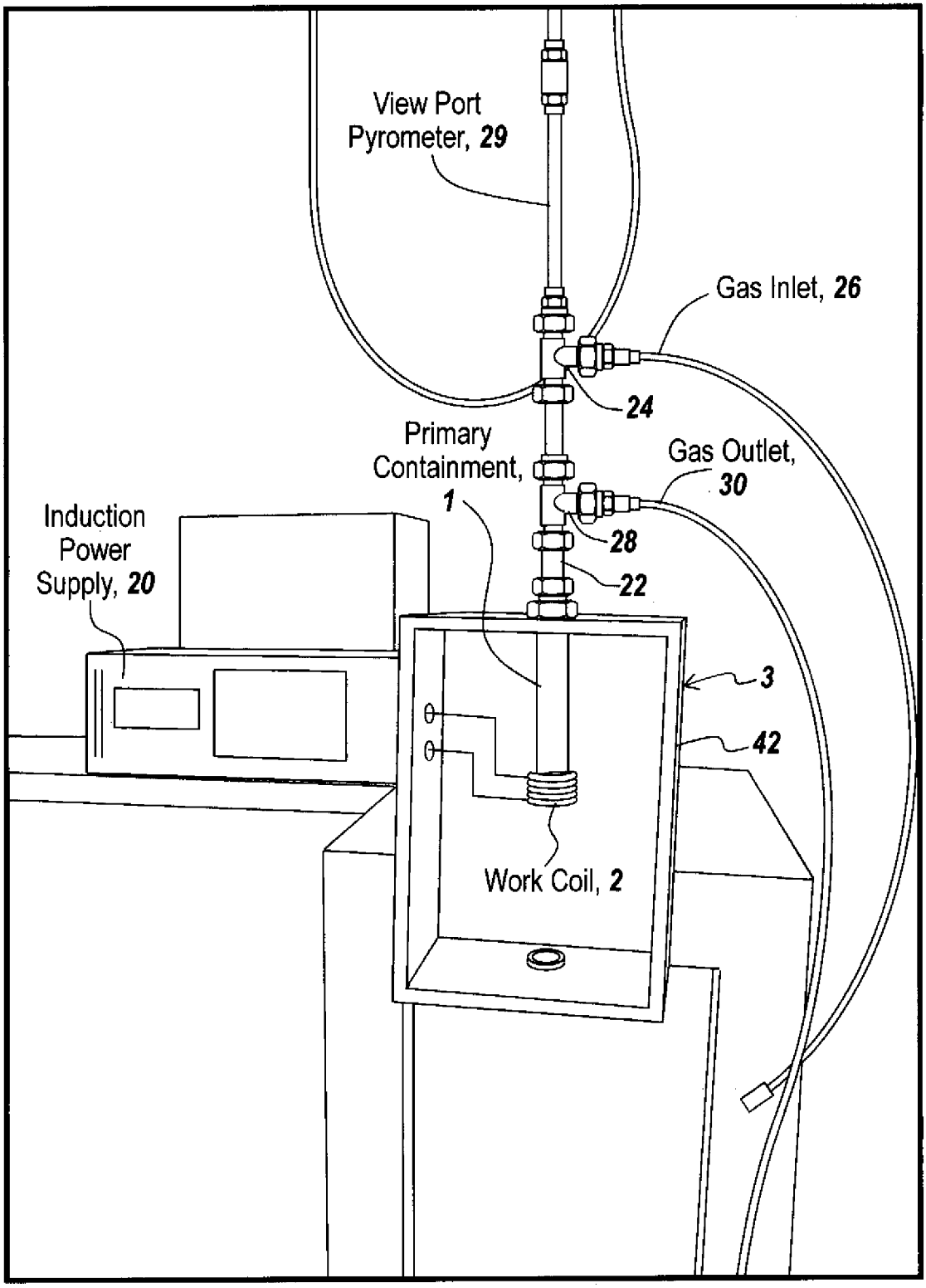
FIG. 12 is a front view of the experimental setup with an induction coil utilized in the process of supercooling metals.

Referring now to FIG. 12, primary containment vessel 1 comprising a tube of non-suscepting material has a work coil 2 located at the distal end thereof. Coil 2 is coupled to an induction power supply 20, as illustrated. The primary containment vessel 1 is located in an enclosure 42 that constitutes a secondary containment vessel 3, with the tube comprising primary containment vessel 1 in communication with a concentric gas delivery conduit 22 through which an optical pyrometer fiber optic probe 6 extends. Conduit 22 includes a gas inlet fitting 24 to which is attached a gas inlet line 26 carrying an air purifying medium such as helium, argon, nitrogen, or neon. Conduit 22 contains concentric internal conduits such that gas inlet fitting 24 is connected to the innermost internal conduit, whereas a gas outlet fitting 28 connected to a gas outlet line 30 communicates with the outer internal conduit such that purging gas is directed downwardly into the primary containment vessel 1 and is removed from the primary containment vessel 1 via gas outlet line 30. It will be noted that fiber optic probe 6 contains a viewport 29.

Figure 13:
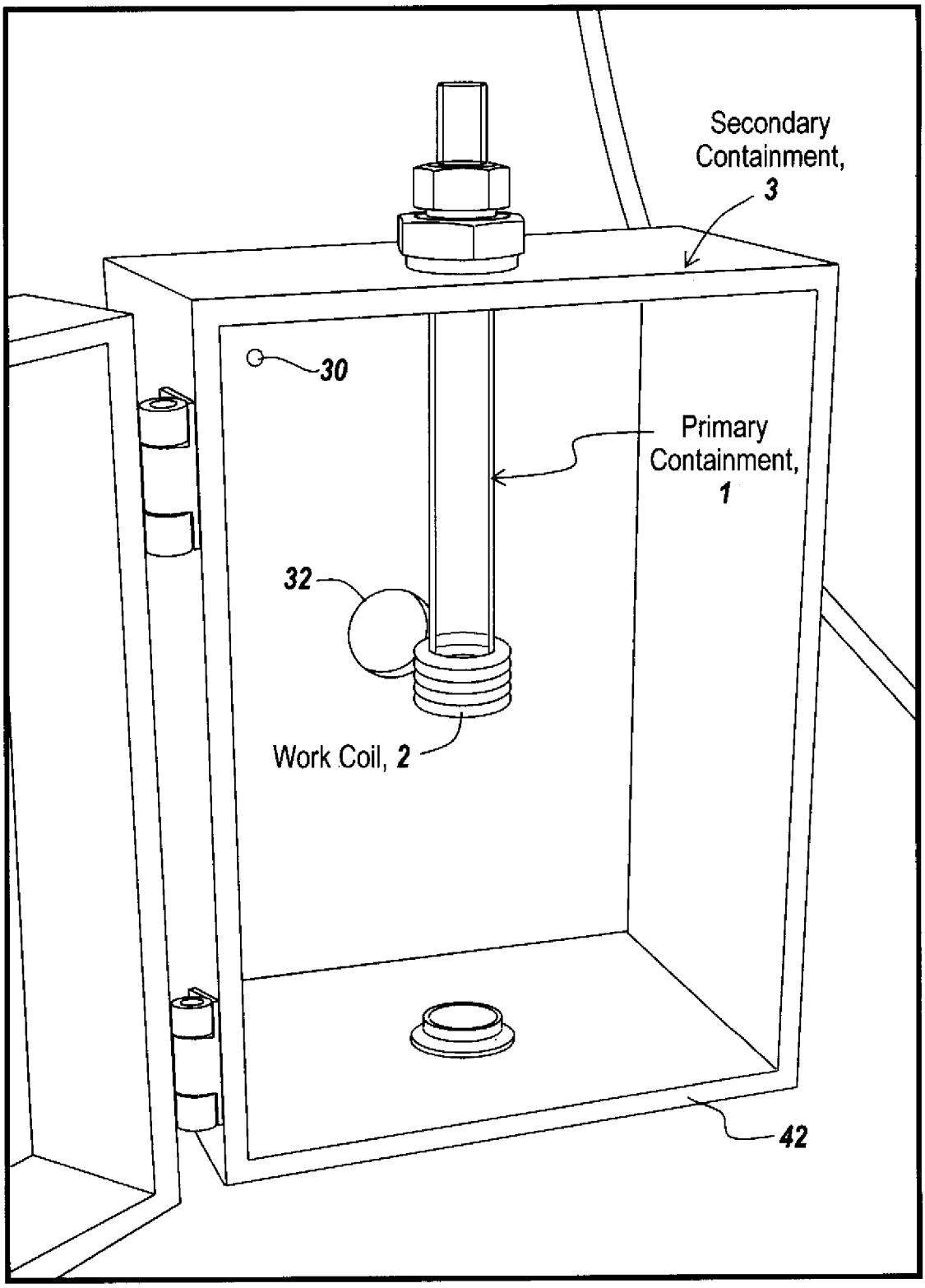
FIG. 13 is a close-up of the front of the secondary containment enclosure of FIG. 1.

Referring to FIG. 13, it will be seen that secondary containment vessel 3 includes a cabinet 42 that encloses primary containment vessel 1 and coil 2 with an optional temperature control medium 5 introduced into the cabinet 42 at orifice 30, which circulates water, steam, alcohol, or oil through the cabinet 42 around primary containment vessel 1 and is exhausted out through exit orifice 32.

Figure 14:
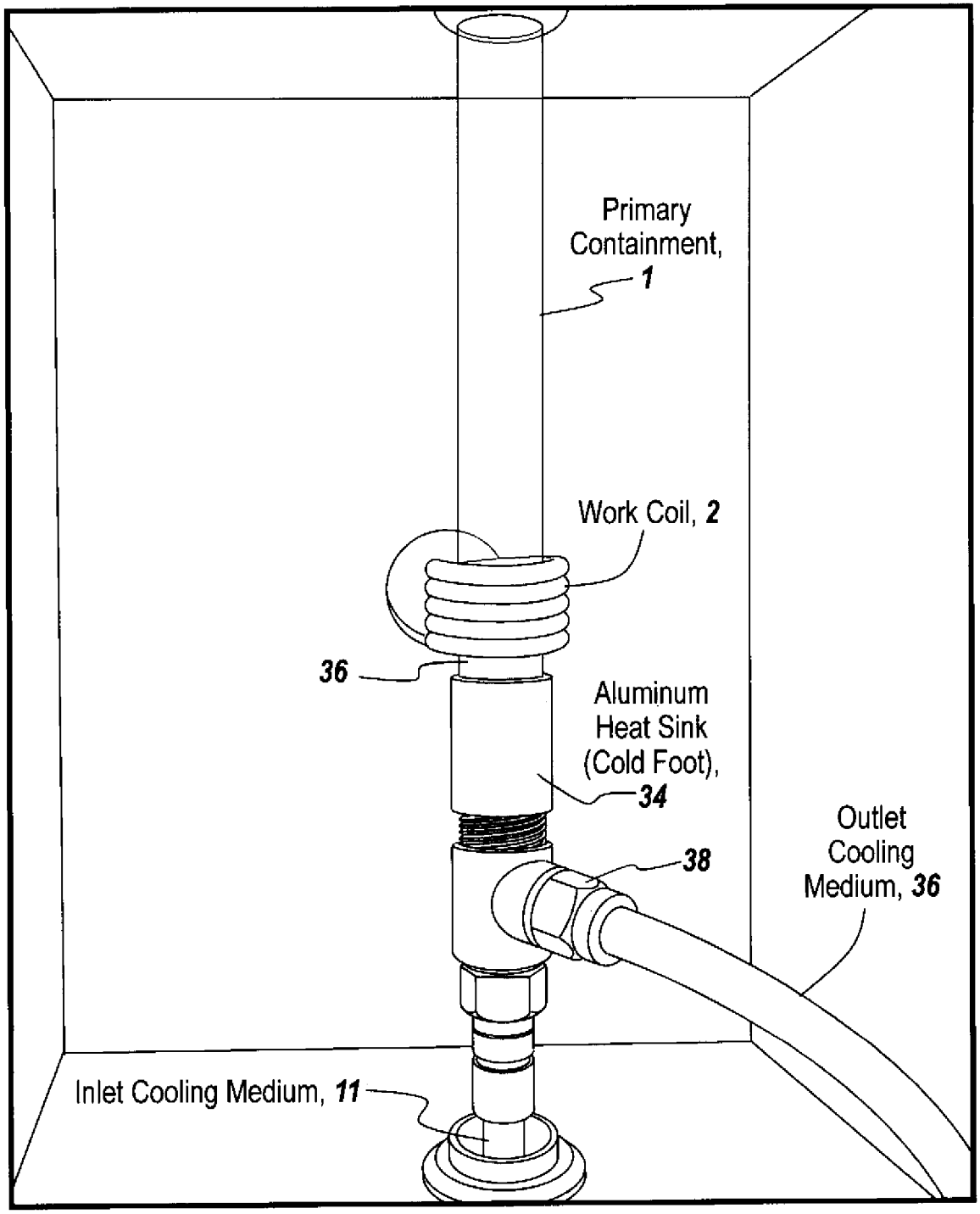
FIG. 14 is a close-up of the front of the secondary containment enclosure of FIG. 4.

Referring to FIG. 14, primary containment vessel 1, with work coil 2, is provided with aluminum heatsink 34 at the base 36 of the primary containment vessel 1. An inlet cooling medium 11 is introduced into the aluminum heatsink 34 and exits through an outlet cooling medium hose 36 coupled to an outlet fitting 38 which communicates with the interior of heatsink 34. The cooling medium 11, therefore, provides a heat transfer medium to cool the heatsink 34.

Figure 15:
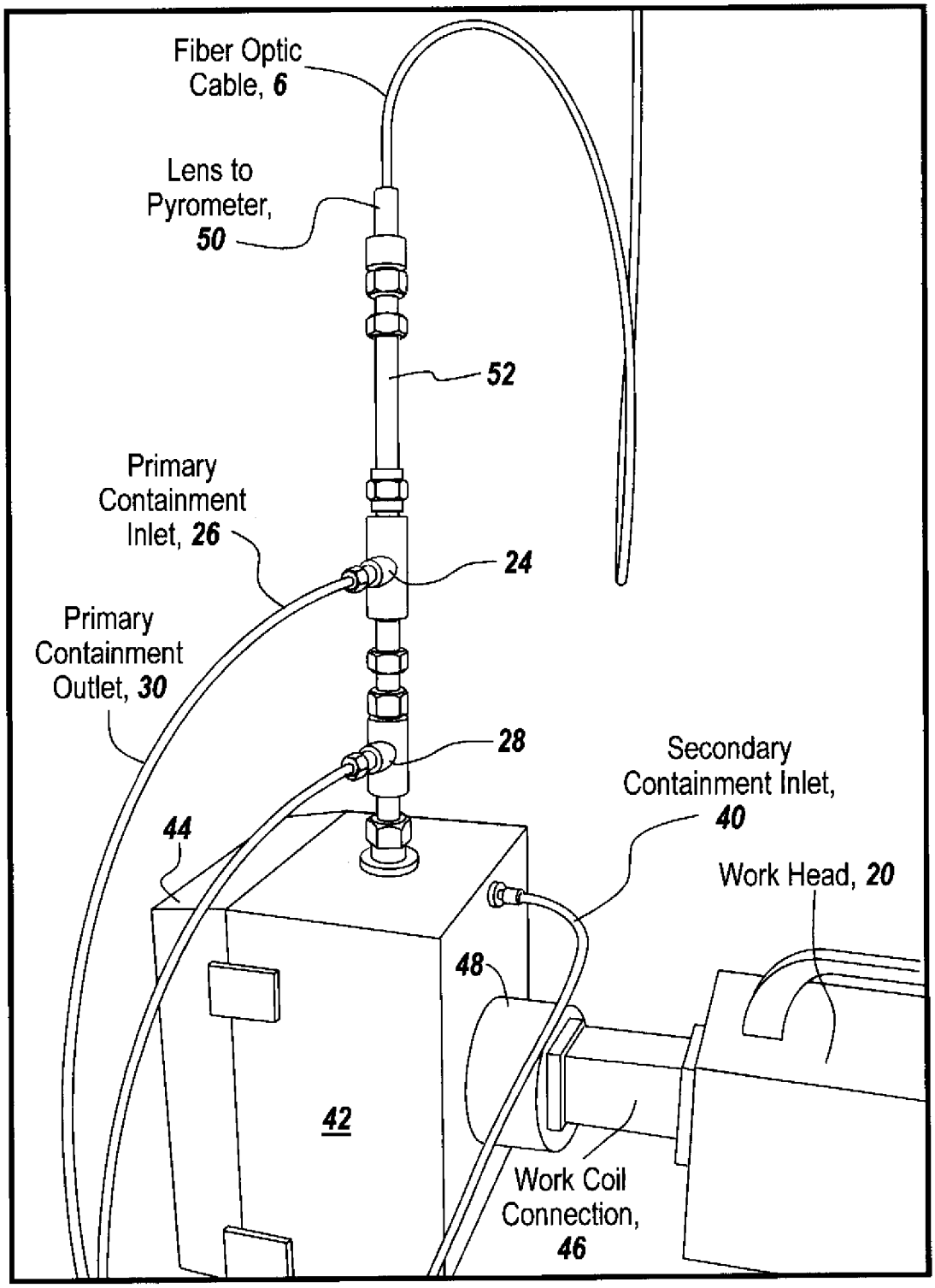
FIG. 15 is a side view of the secondary containment enclosure of FIG. 13.

Referring to FIG. 15 in which like elements have like reference characters, the secondary containment inlet line 40 is shown connected to orifice 30 in the secondary containment vessel 3 cabinet 42, here shown with a closing cover 44 secured to the primary containment vessel cabinet 42. Also shown is induction work head 20 coupled to the work coil 2 through an electrical cabling conduit 46 and a pass-through connection 48 in cabinet 42. Note that a lens 50 is located atop an optical viewport 52 which is coupled by fiber optic cable 6 to the optical pyrometer 7.

Figure 16:
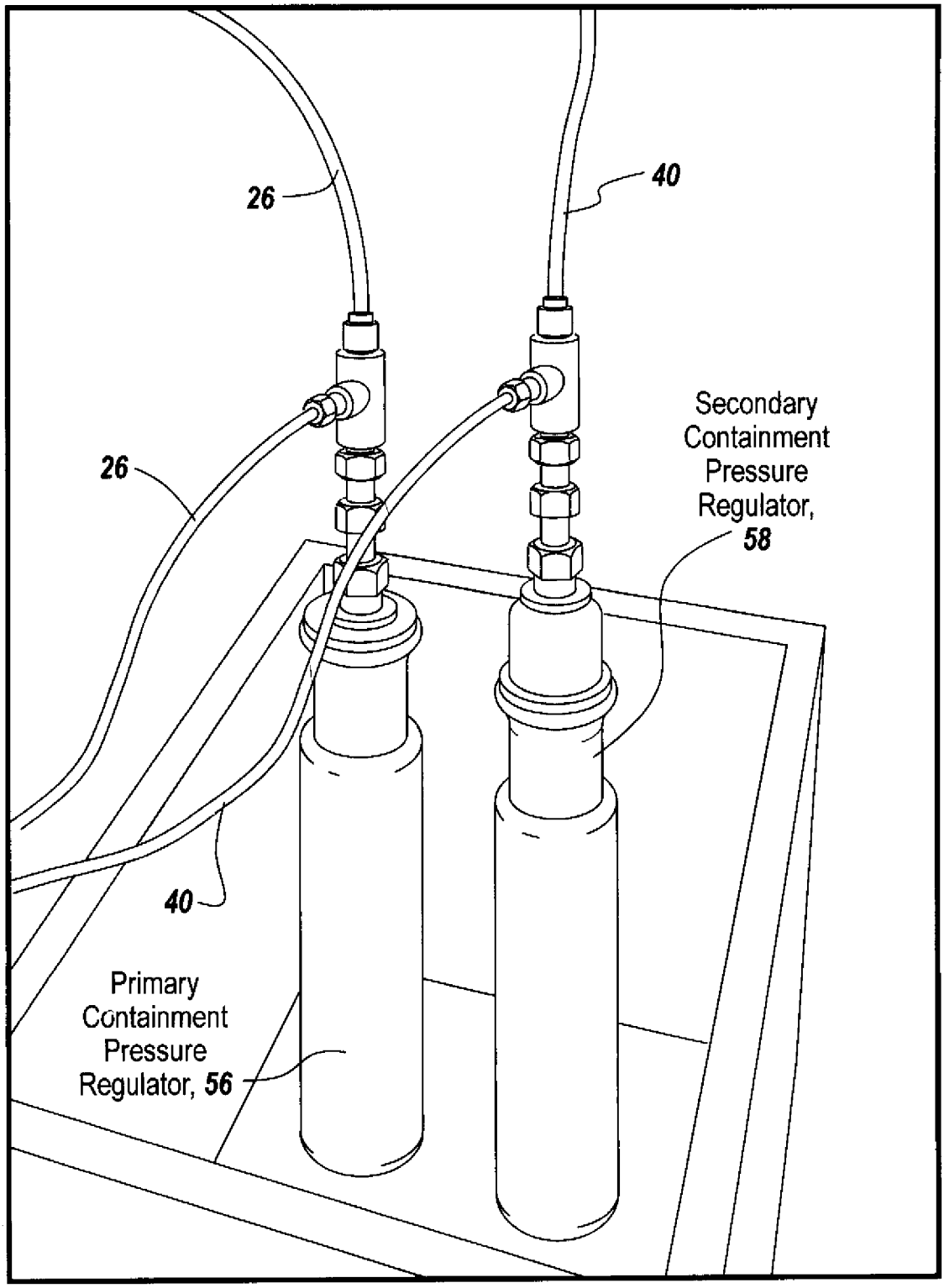
FIG. 16 is a diagrammatic illustration of the water columns utilized in regulating back pressure on the primary and secondary containment enclosures FIG. 13.

Referring to FIG. 16, what is shown are a pair of pressure regulators 56 and 58 to regulate the pressure in the primary and secondary containment vessels 1 and 3, which are respectively coupled to primary containment inlet line 26 and secondary containment inlet line 40 to regulate the pressure of the gases introduced into the primary and secondary containment vessels 1 and 3.

Referring to FIG. 17, the direct-current embodiment of the subject invention includes a primary containment vessel 1, in which a metal bar 20 is located in an open-ended tube comprising an open-ended containment vessel 1 and is contacted at either end by electrodes 60, in turn electrically connected to electrical terminals 62 and DC connection cables 64 for supplying current through metal bar 20. Fitting 66 is utilized to connect a gas inlet 70 carrying a reducing gas to a containment vessel 72 shown in dotted outline which surrounds primary containment vessel 1, whereas fitting 68 couples a gas outlet 76 for the removal of the reducing gas in the containment vessel 72. Due to the open-ended nature of tube 1, the gas in containment vessel 72 circulates within this tube.

It will be appreciated that fittings 66 and 68, as well as electrical terminals 62, will be exceedingly hot and are cooled, in one embodiment, by compressed air cooling nozzles 80 and 82.

More particularly, and as to the operation of the various elements, what is described is the function and the characteristics of the indicated parts of the system.

Primary containment vessel 1. Containment vessel 1 consists of a tube of a non-suscepting material with a closed bottom end. Fused quartz, with its excellent thermal shock resistance and high operating temperature, has been the material of choice, but zirconia and alumina have also been used with successful results. An additional tube (open-ended) made of non-suscepting material (e.g., alumina or quartz) mounted inside the quartz tube acts as a gas outlet to achieve gas circulation closer to the metal surface. The suscepting metal sample, together with any possible additive elements, is placed at the bottom of the quartz tube, which is collinear with the center axis of the work coil 2. Moreover, the sample inside the primary containment 1 is placed at the center of the work coil 2. Several different dimensions on the closed-end tube have been employed to date, including, but not limited to: (1) o.d. 19 mm, i.d. 13 mm; (2) o.d. 18 mm, i.d. 15 mm; and (3) o.d. 12 mm, i.d. 9 mm.

Work coil 2. The work coil 2 depicted is made out of copper, allowing for internal water circulation for cooling purposes. The work coil 2 is painted with a dielectric material to prevent short circuiting. The work coil 2 consists of four windings and has an inner diameter measuring 22 mm and a length of about 20 mm. For most of the samples treated, the work coil 2 operated at 160-180 A during the heating steps (around 60 s) and around 110-140 A during the cooling step when no heat sink is present. With a heat sink present, the current levels to the work coil 2 during the heating step are around 350-450 A and 180-250 A during the cooling step.

Secondary containment vessel 3. The work coil 2 and primary containment vessel 1 are housed in a secondary containment cabinet made of non-suscepting material capable of maintaining a small to moderate positive pressure in terms of inches of water.

Primary containment gas circulation 4. The gas circulation for the primary containment vessel 1 is provided by inlet flow regulated with a mass flow controller connected to a PLC/desktop computer. This circulation allows for convective cooling of the top side of the sample. Various inert cooling media have been employed (e.g., He, $N_2$, Ar), as well as non-inert gases, such as CO and a mixture of Ar/$H_2$ (4% $H_2$) at different flow rates. Most experiments are performed using Ar or Ar/$H_2$ mixture at a modest flow rate of 0.25 l/min. The back pressure on the primary gas flow is kept slightly higher at about an inch as compared to that on the secondary containment 3 in order to detect cracks and possible leaks in the primary containment 1.

Secondary containment gas circulation 5. Gas circulation for the secondary containment vessel 3 involves circulating a cooling medium in the secondary containment 3 that offers some means of regulating the temperature outside the primary containment vessel 1 and, therefore, also heat transfer out of same. Those experiments that have utilized the secondary containment are run with 1-4 l/min flow of $N_2$. The back pressure on the secondary gas flow is kept slightly lower at about an inch as compared to that on the primary flow in order to detect cracks and possible leaks of the primary containment 1.

Optics for IR pyrometer 6. The infrared radiation of the suscepting sample is collected via a light pipe of sapphire or quartz and transmitted to a detector via a quartz fiber optic cable. The light pipe is directed down through the open-ended interior tube in the primary containment vessel 1. Since quartz has a high transmissivity in the operating infrared spectrum of the detector, a lens 50 can also be aimed from outside the primary containment vessel 1. Aiming from the outside alleviates some of the interference caused by turbulence in the melt.

Optical pyrometer 7. A dual-wavelength IR pyrometer made by Williamson Corp. with a nominal operating range of 480-1,750° C. may be used to observe the temperature of the melt. Note that crystallization of a supercooled melt can be observed visually by the sample illuminating rapidly indicating recalescence, as well as a spike in the temperature measurements. Power source 8. In one embodiment, the power source is made by Ambrell Corp. and is capable of delivering up to 10 kW (max 600 A) to the work coil 2. The frequency is internally modulated for circuit balance depending on the load, generally between 250-300 kHz.

Heatsink 9. Placing a water-cooled aluminum heatsink in thermal contact with the primary containment vessel 1 increases the conductive heat loss from the metal 10. Thus, to reach the same sample temperature as in a setup without the heatsink, a stronger field or higher coil-current is required. Aluminum is used because of its excellent thermal conductivity.

Circulating water 10. The aluminum heatsink is cooled by circulating water in thermal contact with the aluminum. The incoming water temperature is regulated at around 22° C. using a PolyScience constant temperature circulator, and the flow rates used were around 0.4-1 gallons per minute.

Method

The supercooling experiments performed to date mainly utilize the apparatus described in FIGS. 1 and 4, in which a sample is placed in vessel 1 and is inductively heated through the utilization of induction heating coil 2, followed by reducing the current to the inductive heating coil 2 to allow cooling. It is noted that, in this embodiment, the influence produced by the coil 2 prevents crystallization or recalescence. All of this was done in an oxygen-free environment due to an oxygen-purging inert or reducing gas stream 4, which filled the vessel 1 above the metal 10. A temperature control stream occupies the space between vessel 1 and surrounding enclosure 3 to manage the heat exterior to vessel 1 safely, although such temperature control medium is considered optional.

After the metal 10 had been brought to its molten state due to the induction heating associated with the application of RF current from current control module 8 at 250-300 kHz and 175 A, or 400 A if the heat sink is employed, the current is reduced. The magnitude of the current supplied to the induction coil 2 is low enough to allow the metal 10 to cool below the melting point but at the same time sufficient to inhibit crystallization. As a result, the current can keep the melt in a supercooled state for an extended period of time. For a 4.39 g nickel sample of 4N5 purity, a current of 108 A during cooling resulted in a steady state supercooling of more than $\Delta T=290$ K.

More particularly, a 10-kW power source is used to generate a radio frequency AC current in an induction coil of 22 mm i.d, 20 mm height, with four windings. The frequency is load-dependent and is fixed to balance the internal circuitry of the power source at around 250-300 kHz. The power source is controlled remotely through a PLC/desktop computer. The metals 10 being supercooled were placed at the bottom of a closed-end vitreous quartz tube, which subsequently was mounted with the suscepting material, metal sample, at the center of the coil 2. This assembly allows for visual inspection of the sample during the process.

The metal 10 temperature was measured with a dual-wavelength pyrometer connected via a quartz fiber optic cable to the detector. The temperature readings were fed to a computer via a PLC, allowing for readings of the temperature trend in real time.

Definitive confirmation of a glassy state cannot be done in real time. However, temperature readings supported by visual inspection of the metal 10 during cooling can offer strong indications as to whether crystallization has occurred or not. Crystallization of the sample is either evidenced by recalescence, which is both a visually noticeable event involving bright illumination, as well as detectable as a spike in temperature readings, or through an observation of a thermal arrest of the cooling temperature curve at the equilibrium melting point.

The induction heating is controlled through the alternating current (AC) delivered to the coil 2. The high sensitivity with respect to position of the metal 10 in the alternating current (AC) magnetic field requires a careful calibration of the current at the start of each run. The quartz tube is purged with an inert or reducing gas (e.g., argon or argon-hydrogen mixture) prior to initial heating, and a minor gas flow is maintained throughout the experiment. After the metal 10 has been melted initially, the system is allowed to soak in the reducing environment before the power to the coil 2 is dropped to levels corresponding to temperatures below the melting point. Once a run is terminated, the samples are left to cool to approximately room temperature before being extracted from the reactor. Weight measurements of the sample pre- and post-experiments, along with XRF analysis of the sample, allow for a determination of any possible foreign elements present.

Figure 22:
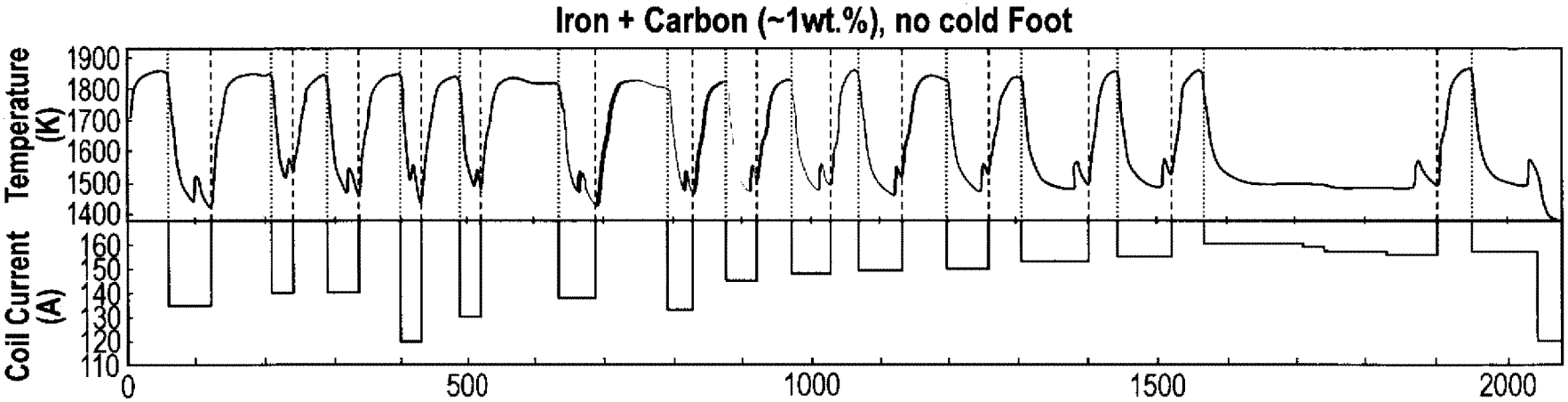
FIG. 22 is a series of graphs of temperature versus time and coil current versus time for an experiment repeatedly supercooling iron plus carbon without the use of a heat sink showing only the coil current during cooling.

Experimental Results Normally, the heating and cooling through the phase transition shows clearly the latent heat of the phase transition on both the heating step and the cooling step in the cycle. This is evidenced by an approximate isotherm or thermal arrest in the temperature trend at the equilibrium melting/solidification temperature. When an electromagnetic field is imposed during cooling, the phase transition can be suppressed, as evidenced by a lack of thermal arrest when passing through the melting point, as well as recalescence below the equilibrium melting temperature, leading to supercooling as shown in FIGS. 17, 20, and 22.

Figure 18:
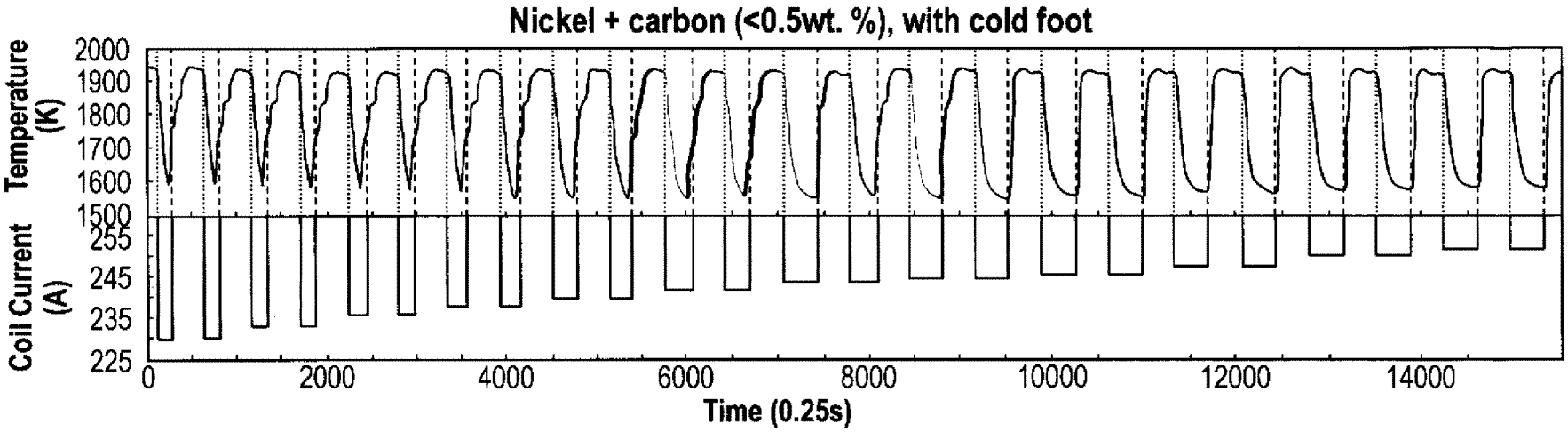
FIG. 18 is a series of graphs of temperature versus time and coil current versus time for an experiment repeatedly supercooling nickel plus a small amount of carbon involving thermal contact with a water-cooled aluminum heatsink according to FIG. 4, only the coil current during cooling being displayed.
Figure 19B:
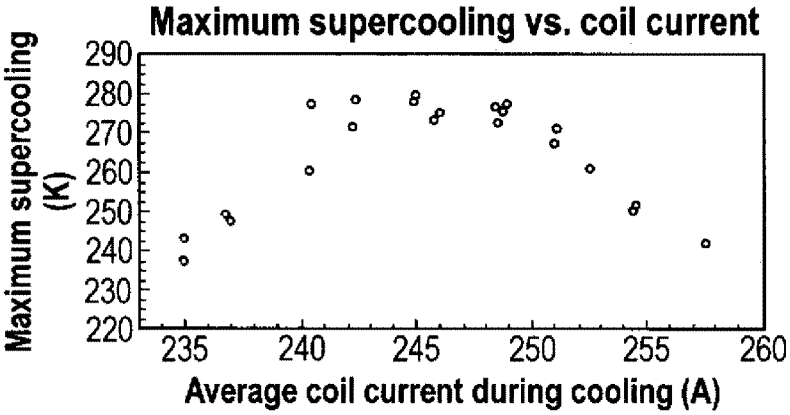
FIG. 19B is a graph plotting the maximum degree of supercooling during each cooling step in FIG. 17 versus coil current during the cooling step for each of the cooling steps shown in FIG. 17.
Figure 19A:
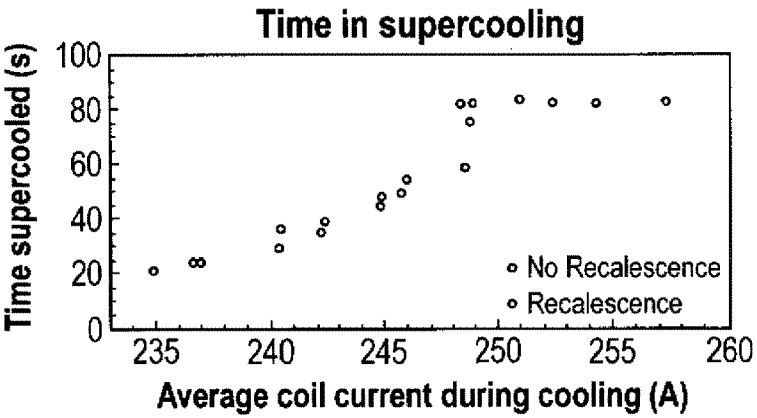
FIG. 19A is a graph plotting the amount of time the metal spent in a state of supercooling versus coil current during the cooling step for each of the cooling steps shown in FIG. 17.
Figure 20:
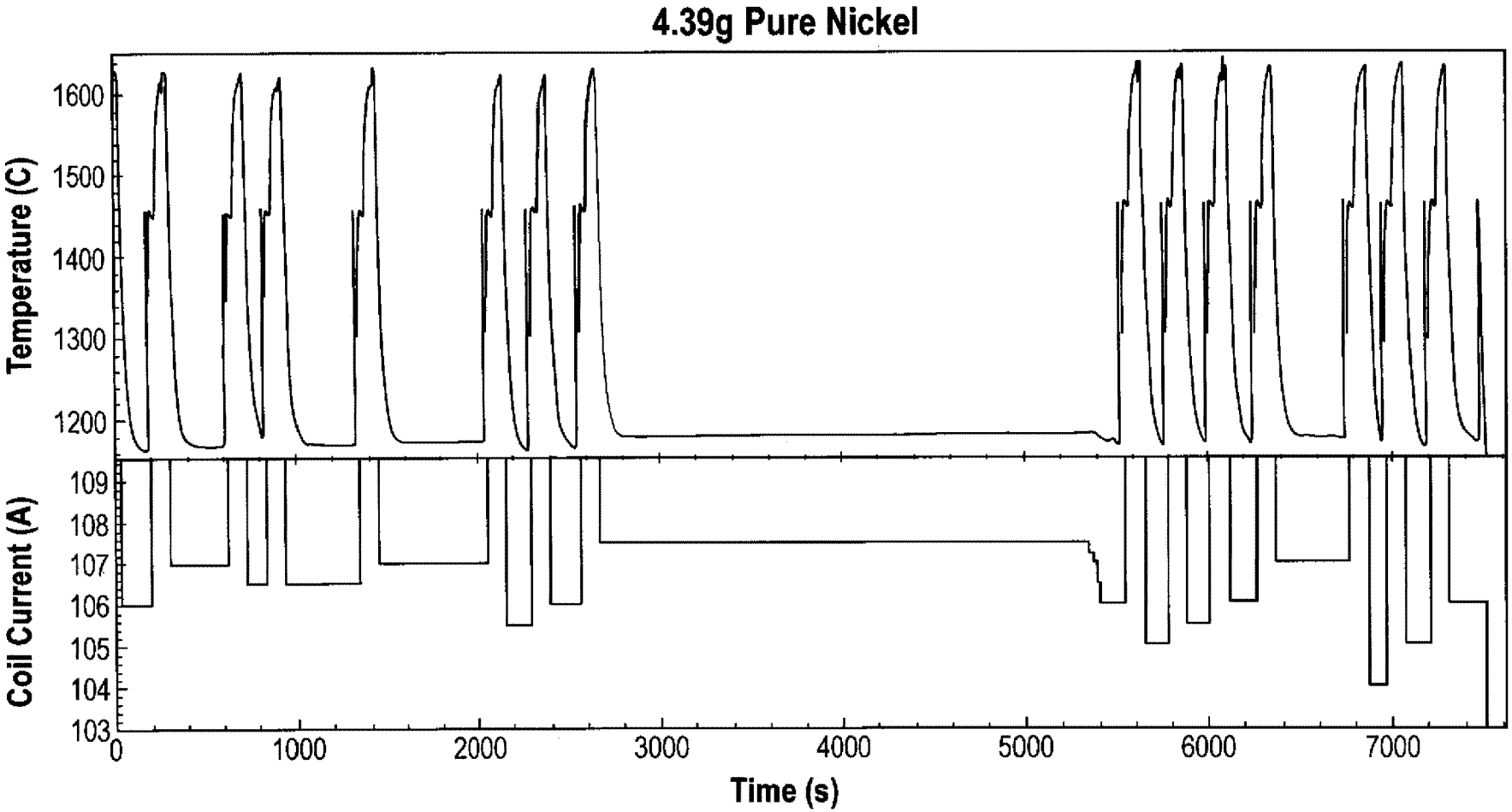
FIG. 20 is a series of graphs of temperature versus time and coil current versus time for an experiment using the induction coil to repeatedly supercool 4.39 g of pure nickel without the use of a heat sink.

In FIGS. 18 and 20, temperature/current readings establish a supercooled state for an extended period of time. As shown in FIG. 20, the readings were recorded from an experiment performed with nickel, of 4N5 (99.995%) purity, whereas as shown in FIG. 18, the readings were recorded from an experiment in which carbon was added at an amount of 0.5 wt. %. The experimental setup used in this FIG. 18 experiment involved a water-cooled aluminum heat sink in thermal contact with the bottom of the primary containment, as illustrated in FIG. 4. The dotted vertical lines in the temperature plot indicate times when current to the coil is decreased. Similarly, dashed vertical lines indicate an increase of current to the coil. The current plot in FIG. 18 shows only the current during cooling to offer higher resolution. The current during heating was maintained at 360-365 A and regulated only to keep the temperature of the superheated melt consistent cycle to cycle. As can be seen in FIG. 18, by increasing the coil current during cooling, the melt reaches deeper levels of supercooling before recalescing, and eventually the current is high enough to prevent recalescence altogether. Further increases in the current beyond this minimum critical current raises the minimum temperature reached during the cooling step since more power is being transferred to the melt. FIG. 19B illustrates this trade-off FIG. 19A shows the time that the metal melt spends in a state of supercooling during each cooling step. It is noticeable that a higher current allows for longer time in a supercooled state. Note that the maximum time in each cooling step was capped at 90 seconds, which is why the trend in FIG. 19A plateaus.

A system comprising pure nickel behaves qualitatively different from that of nickel with added carbon. In order to demonstrate the significant effect of the crystallization suppression provided by the induced electrical currents, comparisons were made to nucleation rates at various temperatures for pure nickel, as found in the prior art. For pure nickel, and returning to FIG. 20, at temperatures of around 300 K below the melting point of nickel, homogeneous nucleation is expected to occur. In the reactor environments of embodiments 1 and 4, heterogeneous nucleation is expected at temperatures well above this level, and the fact that the indicated level of undercooling is achieved with no other measures than a reducing environment is considered remarkable. Nonetheless, it is conventionally believed that a single nucleation event is enough to trigger crystallization of an entire sample, meaning that the probability for crystallization scales with the volume/mass of the sample.

Figure 21:
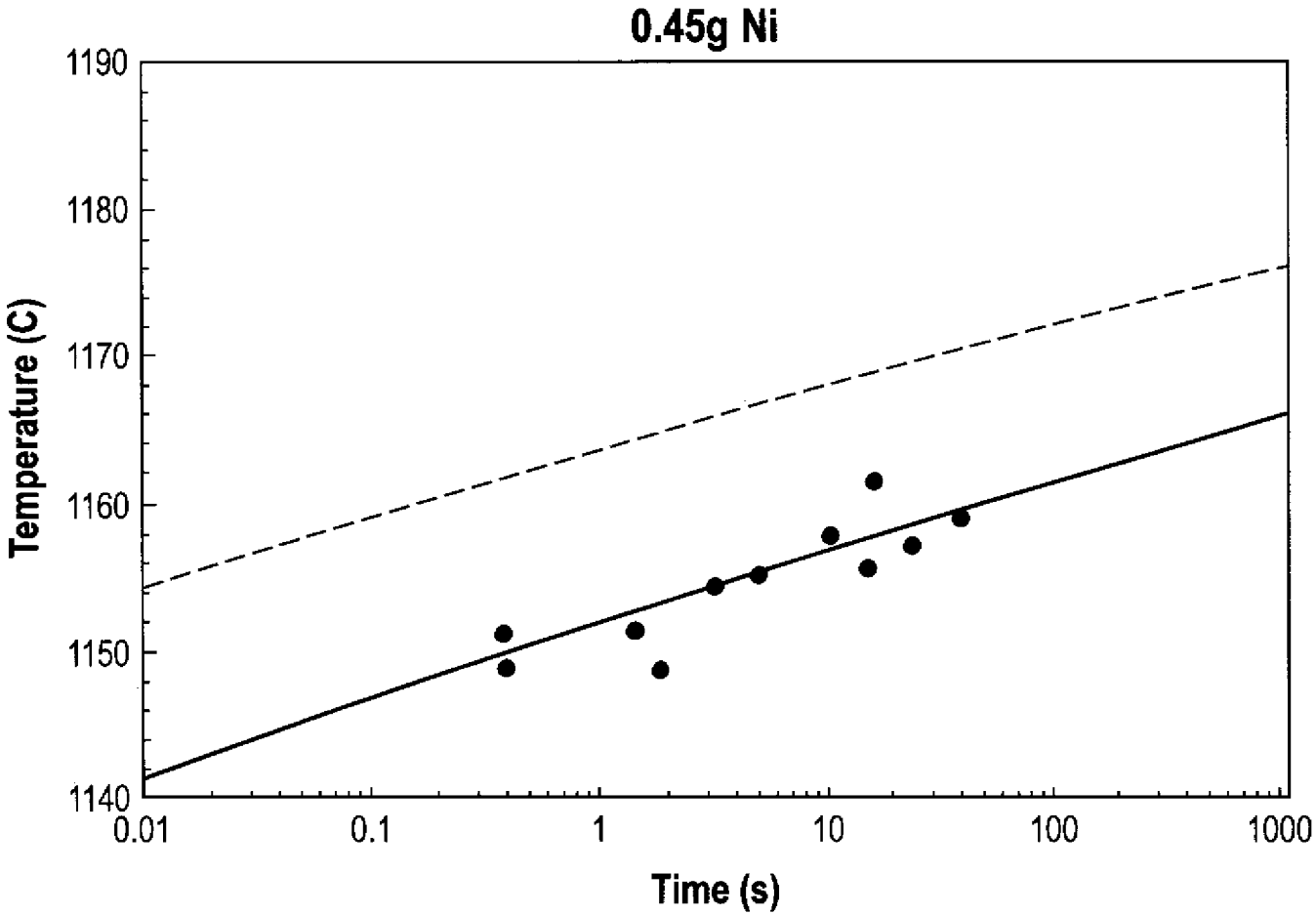
FIG. 21 is a time-temperature-transformation diagram in the top half of the cycles shown in FIG. 20, and in the lower half, a time-temperature-transformation diagram of a similar experiment to the one shown in FIG. 20 but where a heat sink was employed and the sample size was 0.45 g pure nickel.

Referring to FIG. 21, the time, as inferred from published data in the prior art, before homogeneous nucleation is expected to crystallize a sample of a given mass and at a given temperature is marked with a dashed line. As seen from the solid line, for a 0.45-g nickel sample, the observed nucleation rates are significantly slower. Interestingly, the deviation from expected rates is greater for a smaller sample. This observation is attributed to the penetration depth of the electromagnetic field and the corresponding spatial distribution of the induced electrical currents. Using the same frequency of the field for different sample sizes, the proportion of the sample that is exposed to electrical currents is greater for a smaller sample. Since the induced electrical currents are believed to be the main factor in suppressing crystallization, this explains why the deviation from expected behavior is greater for a smaller sample.

Figure 23B:
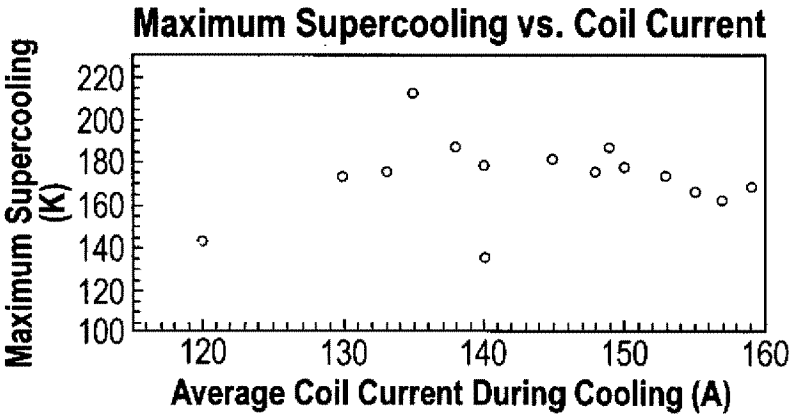
FIG. 23B is a graph showing the maximum degree of supercooling during each cooling step in FIG. 22 versus coil current during the cooling step for each of the cooling steps shown in FIG. 22.
Figure 23A:
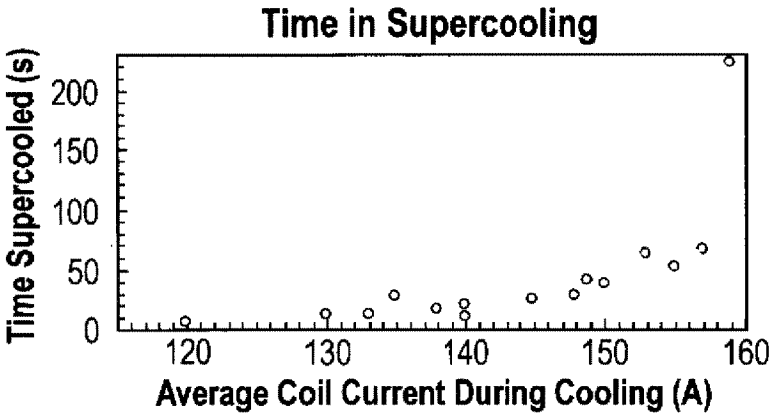
FIG. 23A is a graph showing a plot of the amount of time the metal spent in a state of supercooling versus coil current during the cooling step for each of the cooling steps shown in FIG. 22.

Data from another experiment performed on a system comprised by iron and carbon can be seen in FIGS. 22, 23A, and 23B. The same effect of a minimum critical current to reach a maximum stable level of supercooling as in FIGS. 18, 19A, and 19B for nickel plus carbon is noticeable here as well. Thus, the method is not specific to only nickel but applicable to other systems as well.

Figure 24:
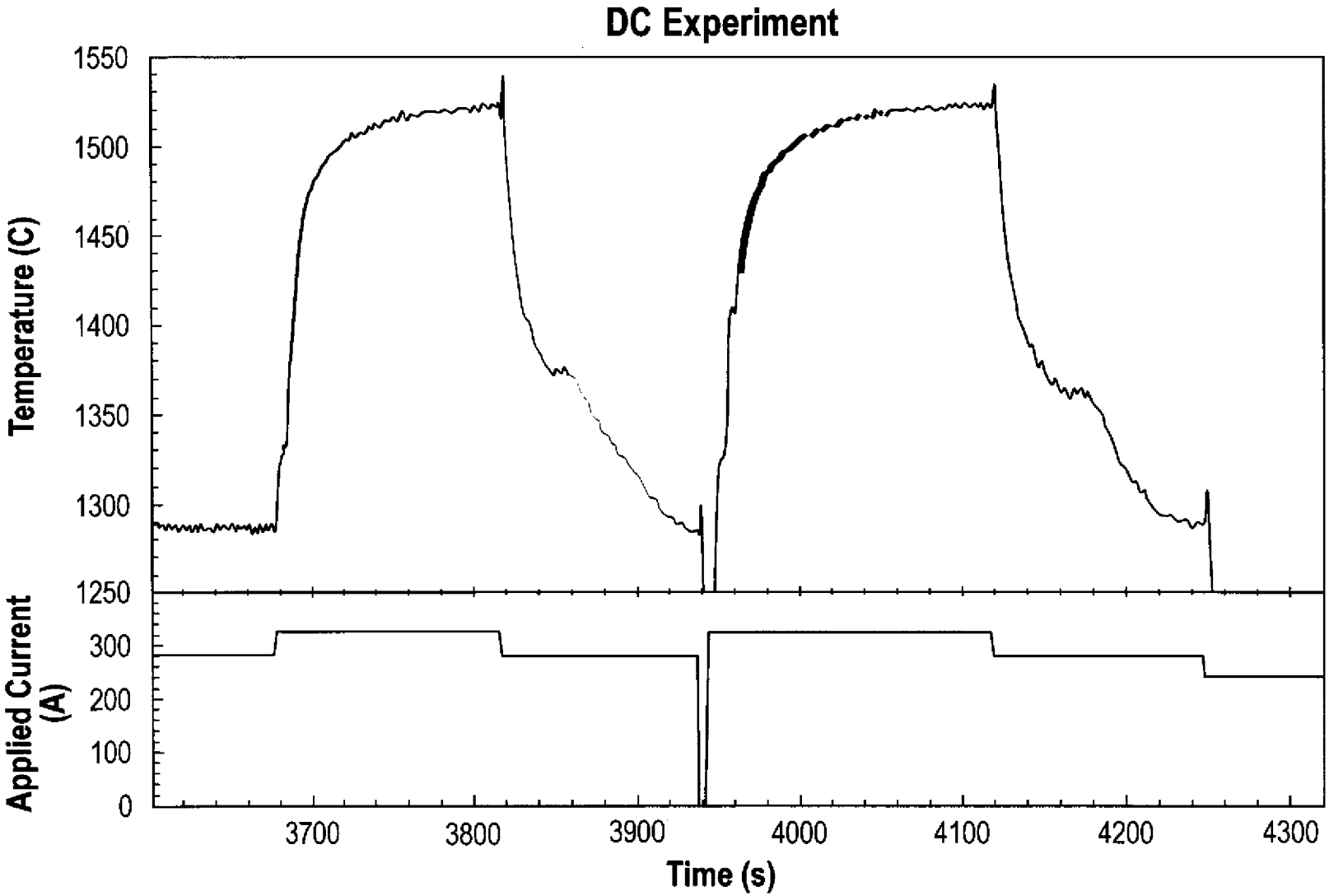
FIG. 24 is a series of graphs of temperature versus time and applied current versus time for a nickel sample treated in the DC reactor of FIG. 17.

Data from an experiment on nickel using direct current can be seen in FIG. 24. Two cooling cycles are shown in the temperature versus time and current versus time graph. The behavior is markedly different from data gathered using the induction coil. For instance, there is a noticeable thermal arrest on both cooling curves indicating partial normal solidification. However, and importantly, after this thermal arrest, if the current through the sample is cut completely or stepped down, there is a noticeable spike in the temperature readings, which is proof of solidification of an undercooled melt. This offers a proof of concept in that at least part of the sample was maintained in a liquid state below liquidus by the supplied currents.

The main scientific and expected difference between the DC and the induction setup is that the current density in the former should be uniform through the metal, as there are no frequency or skin depth issues with a direct current. That is an advantage of the DC, as the currents reach even the center of the sample. The disadvantage is that the electrodes touching the melt introduce potent nucleation sites that a vitreous quartz tube does not, at least not to the same extent. An interpretation of the temperature graphs is that there is a part of the metal that actually solidifies normally as indicated by the thermal arrest. However, the observed recalescence in the graphs suggest that part of the liquid can nonetheless stay supercooled.

From an engineering perspective, there is also a heat transfer issue to take into account. Whatever electrode material that is chosen, graphite in the illustrated case, it will not only be a good electric conductor but also a good thermal conductor. Thus, with the relatively small dimensions that have been tested so far, there are significant thermal gradients.

Moreover, experimental experience tells us that the ability of the sample to supercool is sensitive to both the integrity of the quartz crucible and the amounts of oxides present in the sample. If the quartz tube chips and releases grains of quartz into the melt, supercooling is difficult to achieve. The role of oxides in catalyzing nucleation is well known in the literature. A common mitigation practice for this problem is to use some form of gettering system, a component that removes trace impurities (e.g., oxygen) from a gas stream, to assure a very low oxygen partial pressure in the reactor. Also, ingots are typically etched with acids to remove surface oxides present on the ingot. Instead, a reducing agent in the form of carbon (e.g., graphite) is introduced in the reactor or hydrogen is mixed into the purge gas. The experimental procedure is initiated by up to 30 minutes of soaking at a temperature above the melting point of the metal to ensure homogeneous distribution of the carbon, if added, and reduction of most oxides present.

Figure 25A:
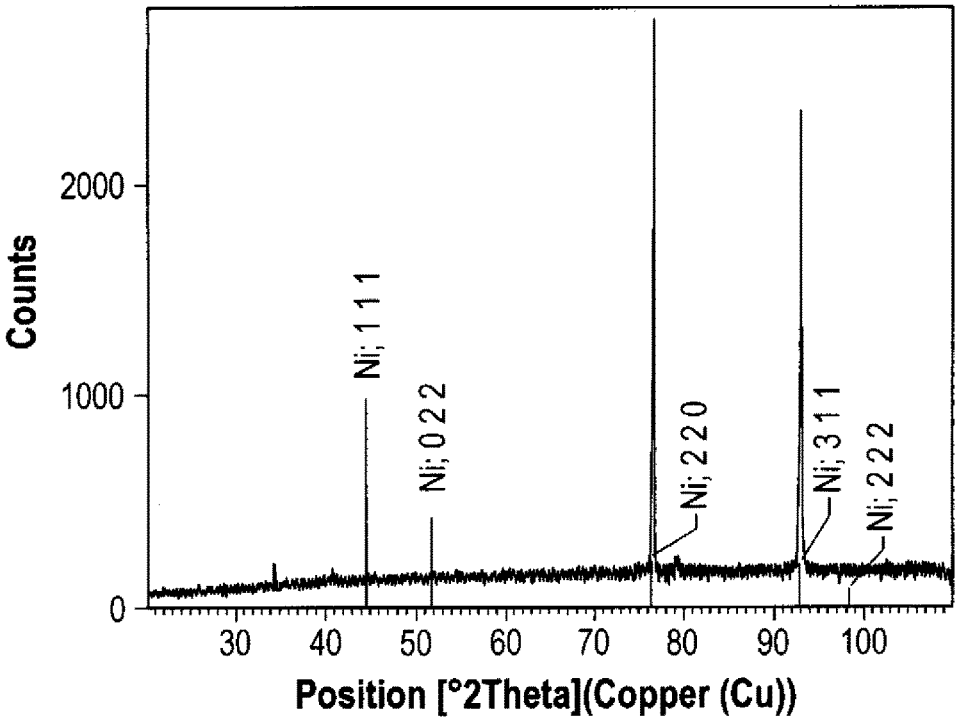
FIGS. 25A and 25B are X-ray diffraction patterns of the same sample, with FIG. 24A showing the pattern made from a scan made on the surface of the metal and FIG. 24B showing a pattern from a scan made of powder filed from the same sample.
Figure 25B:
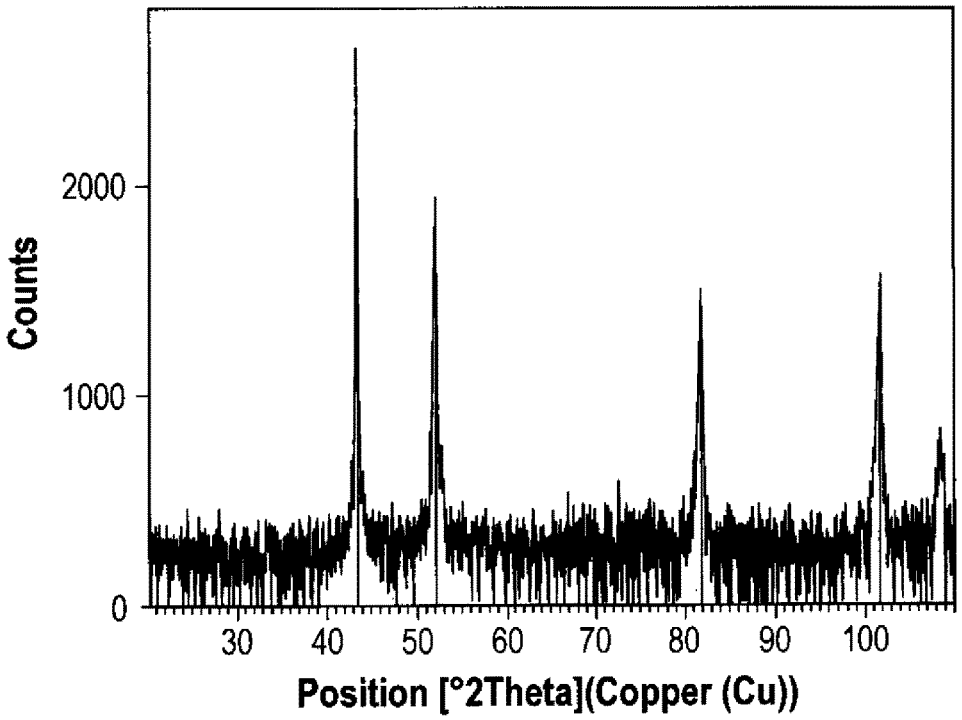
Figure 26:
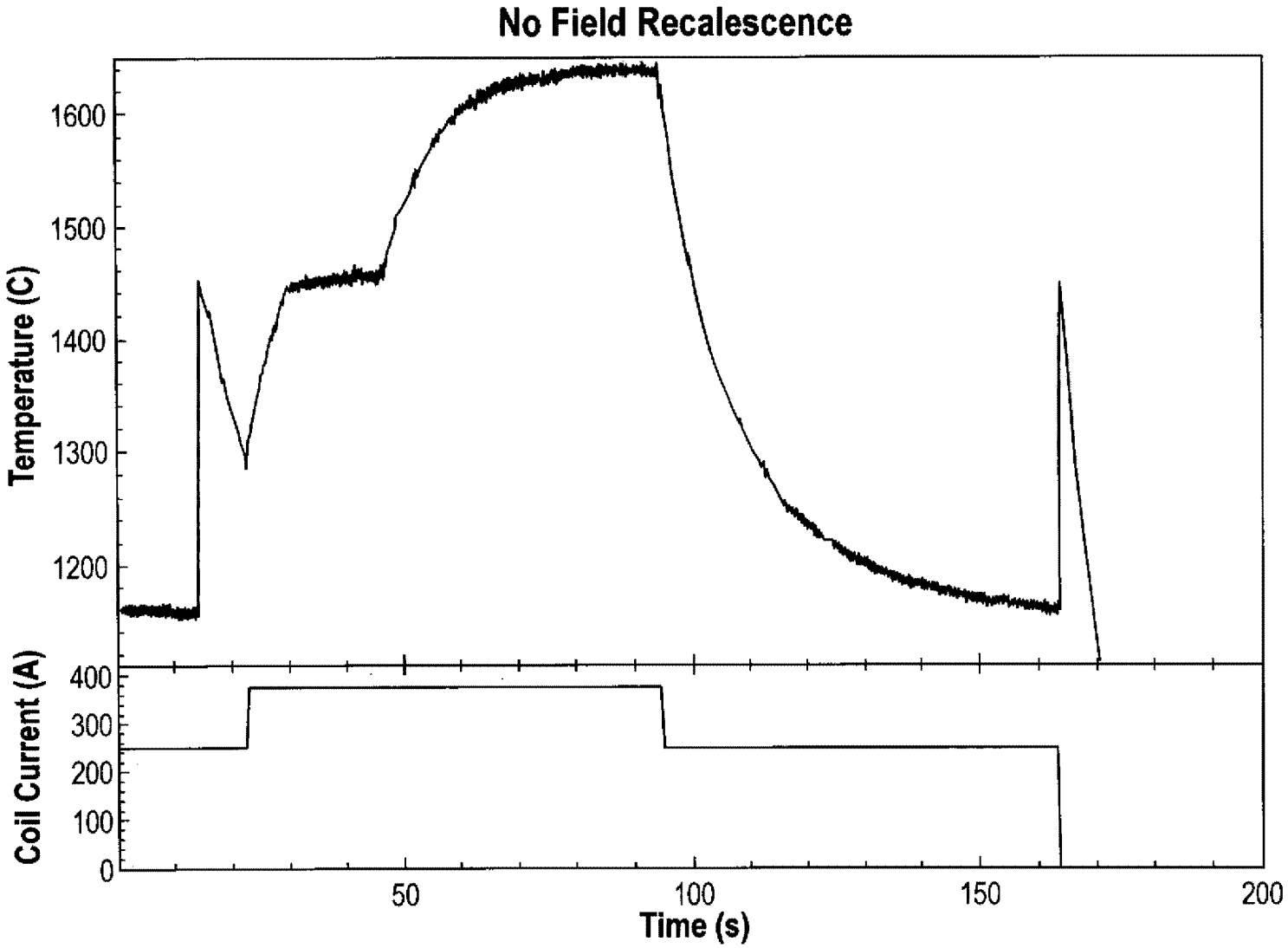
FIG. 26 is a series of graphs showing the last cooling step of a sample where crystallization is triggered by turning off the coil current completely.

Lastly, if a metal is allowed to crystallize when subjected to an electromagnetic field, the crystal structure can be manipulated, for instance, in crystal size and orientation. In FIG. 25A, an XRD-pattern from a scan taken on the surface of a treated metal sample reveals a directional solidification as evidenced by the missing (1,1,1), (2,0,0), and (2,2,2) diffraction peaks of nickel. As shown in FIG. 25B, those peaks always show up when scanning powder filed from the same sample. Thus, the field aligns the crystal structure during solidification. Such manipulation can result in enhanced properties, like electrical and thermal conductivity. As seen in FIG. 26, a sample was allowed to solidify at significant undercooling but with no current applied. In this instance, the current to the coil was cut, causing instant solidification, as exhibited by recalescence of the sample, as seen by the spike. As described hereinabove, the application of electromagnetic current significantly eliminates or delays the onset of recalescence.

Figure 27:
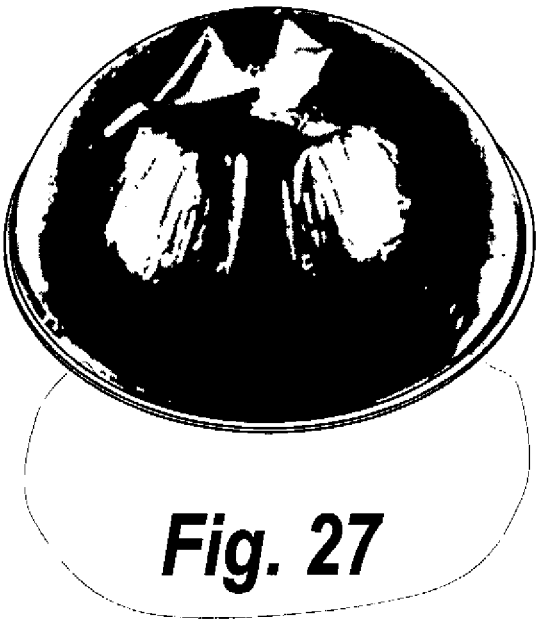
FIG. 27 is a photograph of the sample extracted following the solidification in FIG. 26.
Figure 28:
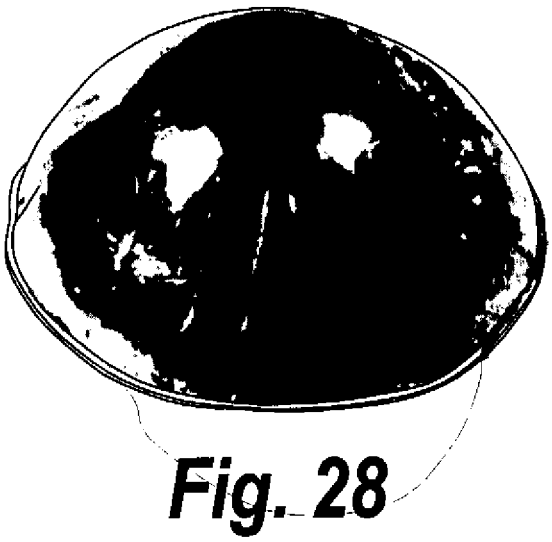
FIG. 28 is a photograph of the sample extracted utilizing a field to limit crystallization.

Referring to the photographs of FIGS. 27 and 28, the tops of samples in which a field was not applied and in which a field was applied are shown. The main distinguishing feature is that, by cutting the field completely, one removes the pinching effect on the metal caused by Lorentz forces on the induced current. As a result, and as shown in FIG. 27, the sample starts collapsing under gravity, and crystallization happens before the surface has acquiesced, giving the jagged appearance on the top of the sample in FIG. 27 as compared to the smooth surface in FIG. 28.

Figure 29:
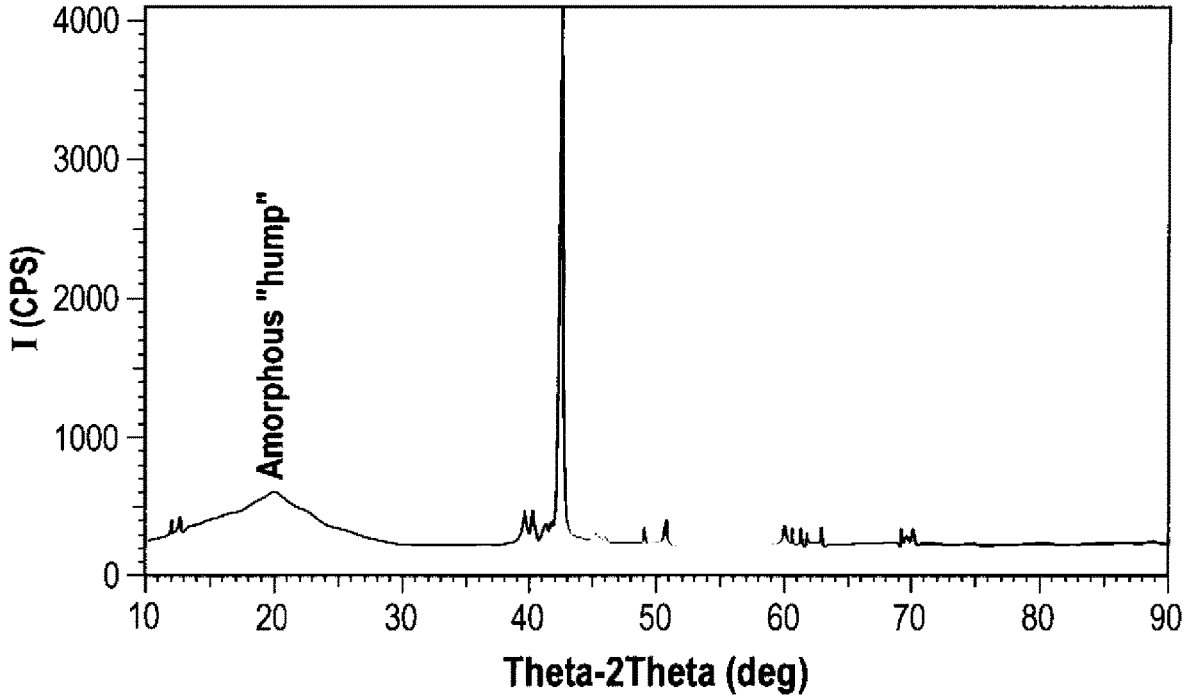
FIG. 29 is an XRD diffraction plot of an NiNb sample showing the formation of an amorphous material.

Referring to FIG. 29, an XRD plot of a sample of NiNb is shown, indicating a substantial amorphous phase in the material as indicated by the amorphous hump at low 2theta angles. This amorphous phase was obtained utilizing the apparatus of FIG. 4, in which the melted sample was cooled in its supercooled state down to ambient temperature. The result is at least a portion of the sample having amorphous phase characteristics.

Figure 30:
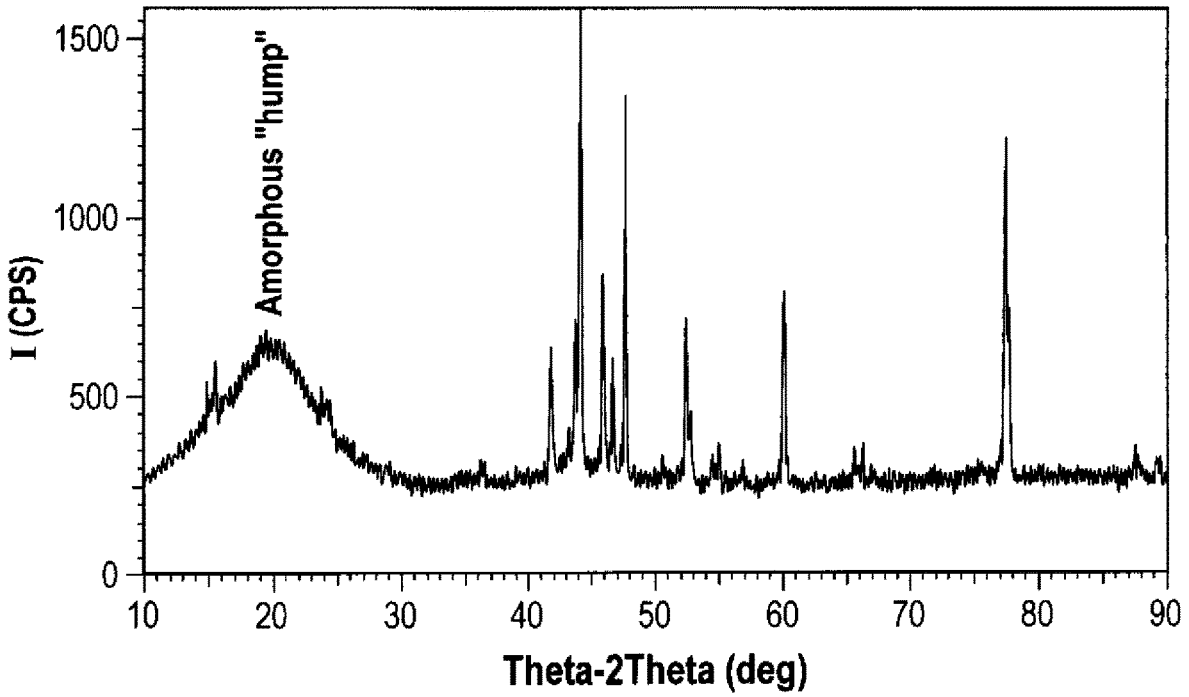
FIG. 30 is an XRD diffraction plot of an NiB sample showing the formation of an amorphous material.

Referring to FIG. 30, likewise, an XRD plot of a sample of NiP is shown, indicating a substantial amorphous phase in the material as indicated by the amorphous hump at low 2theta angles. This amorphous phase was obtained utilizing the apparatus of FIG. 4, in which the melted sample was cooled in its supercooled state down to ambient temperature. The result is at least a portion of the sample having an amorphous phase characteristic.

In short, for these two samples, the result is the same in that a substantial amorphous phase exists for a molten metal cooled down while at the same time injecting energy sufficient to prevent crystallization during supercooling, with the supercooled material being cooled to ambient temperatures to achieve an amorphous metal at room temperature.

In summary, the results show the ability to cool a melt in a controlled fashion to significant levels of supercooling without crystallization, as evidenced by absence of both thermal arrest and recalescence. Moreover, XRD analysis on different samples shows presence of an amorphous phase at room temperature. If a strong enough electromagnetic field can be applied during cooling of an appropriate material such that the metal melt reaches the glass transition temperature, then several of the main problems in producing glassy metals are solved: (1) the ability to generate amorphous metals in a "dirty" reactor containing numerous nucleation sites; (2) the ability to make amorphous metals without requiring rapid quenching; and (3) the ability to increase the size of the glassy metal produced since no quenching is required. In addition to these three problems, (4) it is likely that this method allows for a greatly increased variety of compositions of the glassy metals to be produced including pure metals like those used in the above experiments.

Even if the strongest field attainable is not enough to reach the glass transition temperature for a given metal system with this method alone, combining this method with known methods will lower the threshold of the amount of heat that needs to be extracted through quenching. Thus, the problems mentioned above will at least be mitigated by combining the subject method with prior art methods of producing glassy metals.

Repeated experiments have shown the ability to supercool a system comprising nickel, nickel plus small amounts of carbon, iron plus carbon, pure cobalt, and pure copper, respectively, by controlling the amount of energy injected into the melt. This opens the door to making glassy metals from far more starting metals and metal alloys than currently thought possible. The data presented were obtained with the metal in contact with a quartz crucible, meaning that the environment offers a multitude of possible nucleation sites. Prior efforts to make amorphous metals often require much more complex reactors, which attempt to limit or eliminate heterogeneous nucleation sites. Finally, the possibility of sustaining a metal in thermal steady state at significant supercooled temperatures further indicates the possibility to control the processing of glassy metals.

The use of electromagnetic fields during cooling strongly appears to be the primary factor suppressing normal solidification, as well as recalescence. The hypothesis at this point is that the anisotropy of a supercooled melt with small solid clusters could preferentially absorb the energy from the injected EM field at the solid/liquid interface, thereby melting the formed clusters.

While the current efforts have employed an induction coil to expose the melt to an electromagnetic field, a current applied directly to the material has shown to qualitatively yield the same effect of suppressing crystallization. Such a direct coupling would substantially increase the ability to mold glassy metals into a given shape (e.g., sheets, rods, beams, and other geometries).

While the present invention has been described in connection with the preferred embodiments of the various Figures, it is to be understood that other similar embodiments may be used or modifications or additions may be made to the described embodiment for performing the same function of the present invention without deviating therefrom. Therefore, the present invention should not be limited to any single embodiment, but rather construed in breadth and scope in accordance with the recitation of the appended claims.

What is claimed is:

1. A method of forming an at least partially amorphous metal, the method comprising:

heating a metal to a molten state; and allowing the molten metal to cool below its melting point while subjecting the molten metal to an electric current that is at least one of:

induced in the molten metal by application of an AC magnetic field to the molten metal, wherein the AC magnetic field is generated utilizing an AC current having a frequency in the range of 250-300 kHz; and applied directly to the molten metal utilizing at least one electrode that contacts the molten metal, wherein the electric current is so applied after the metal has reached its molten state.

2. The method of claim 1, wherein at least a portion of the method is performed in a chemically reducing environment.

3. The method of claim 2, wherein the chemically reducing environment is provided by the presence of at least one of graphite powder and hydrogen gas.

4. The method of claim 1, wherein heating the metal involves utilization of an induction coil.

5. The method of claim 4, wherein:

before the metal has reached its molten state, the induction coil is driven by said AC current at a first non-zero current magnitude; and after the metal has reached its molten state, the induction coil is driven by said AC current at a second non-zero current magnitude that is less than the first non-zero current magnitude and that permits the molten metal to cool below its fusion point without crystallization.

6. The method of claim 4, wherein the induction coil is configured as a single coil arranged such that the metal resides interior of the induction coil.

7. The method of claim 4, wherein the induction coil is configured as a split coil arranged such that the metal resides interior of the induction coil at a gap between a first quantity of turns of the induction coil and a second quantity of turns of the induction coil.

8. The method of claim 4, wherein the induction coil is configured as a pair of two separate coils arranged such that the metal resides exterior of each of the two coils at a gap between the two coils.

9. The method of claim 1, wherein the metal comprises at least one of nickel, iron, cobalt, copper, an alloy, and a composition including a metal and a carbon additive.

10. The method of claim 1, wherein:

the molten metal is contained in a primary containment vessel; and the method further comprises:

providing a heatsink in thermal contact with the primary containment vessel to assist in increasing a degree of supercooling of the molten metal by decreasing a thermal equilibrium supercooling temperature of the molten metal below the normal solidification temperature of the metal over that established without utilizing the heatsink.

11. The method of claim 1, wherein:

the molten metal is contained in a primary containment vessel; and the method further comprises:

providing a heatsink in thermal contact with the primary containment vessel; and providing additional energy to the molten metal in proportion to an amount of cooling provided by the heatsink for increasing crystallization suppression and thus increasing a degree of supercooling.

12. The method of claim 1, wherein allowing the molten metal to cool comprises:

reducing the temperature of the molten metal to ambient room temperature.

13. The method of claim 1, wherein the electric current induced in the molten metal is induced utilizing a coil surrounding the metal, through which coil the AC current is passed.

14. The method of claim 1, wherein the at least one electrode comprises two or more electrodes that contact the metal.

15. The method of claim 1, further comprising:

applying additional electromagnetic energy to the molten metal while cooling the molten metal via a cooling feature so as to increase its superconducting $\Delta T$ and thus its degree of superconductivity.

16. The method of claim 15, wherein the amount of additional electromagnetic energy is equal to the amount of energy removed by the cooling feature.

17. The method of claim 1, wherein the electric current applied directly to the molten metal is also applied in heating the metal to its molten state, wherein the electric current is so applied as a step-function comprising:

a first non-zero current magnitude while heating the metal to its molten state; and a second non-zero current magnitude while allowing the molten metal to cool below its melting point, wherein the second non-zero current magnitude is less than the first non-zero current magnitude.

18. The method of claim 17, wherein at least one of the first non-zero current magnitude and the second non-zero current magnitude is substantially constant in magnitude.

19. The method of claim 17, wherein both the first non-zero current magnitude and the second non-zero current magnitude are substantially constant in their respective magnitudes.

20. The method of claim 17, wherein the electric current applied directly to the molten metal is a DC current.

21. The method of claim 17, wherein the electric current applied directly to the molten metal is an AC current.

22. The method of claim 1, wherein the electric current is applied directly to the molten metal for a period of at least 1 second.

23. A method for producing a supercooled thermal steady state in a metal, the method comprising:

heating the metal to a molten state; and cooling the molten metal to a fixed temperature below its melting point and maintaining the molten metal at the fixed temperature while applying energy to the molten metal to suppress crystallization, wherein the applied energy is provided by at least one of:

an electric current induced in the molten metal by application of an AC magnetic field thereto, wherein the AC magnetic field is generated utilizing an AC current having a frequency in the range of 250-300 kHz; and an electric current applied directly to the molten metal utilizing at least one electrode that contacts the molten metal, wherein the electric current is so applied after the metal has reached its molten state.

24. The method of claim 23, wherein the applied energy is sufficient to control at least one of crystal structure, grain size, crystal length, and orientation during crystallization.

25. The method of claim 23, wherein the electric current applied directly to the molten metal is also applied in heating the metal to its molten state, wherein the electric current is so applied as a step-function comprising:

a first non-zero current magnitude while heating the metal to its molten state; and a second non-zero current magnitude while cooling the molten metal to the fixed temperature below its melting point and maintaining the molten metal at the fixed temperature, wherein the second non-zero current magnitude is less than the first non-zero current magnitude.

26. The method of claim 25, wherein the electric current applied directly to the molten metal is a DC current.

27. The method of claim 25, wherein the electric current applied directly to the molten metal is an AC current.

28. The method of claim 25 wherein at least one of the first non-zero current magnitude and the second non-zero current magnitude is substantially constant in magnitude.

29. The method of claim 25 wherein both the first non-zero current magnitude and the second non-zero current magnitude are substantially constant in their respective magnitudes.

30. The method of claim 23, wherein the electric current is applied directly to the molten metal for a period of at least 1 second.

* * * * *